US010808732B2

(12) United States Patent
Afshari

(10) Patent No.: US 10,808,732 B2
(45) **Date of Patent: *Oct. 20, 2020**

(54) SYSTEM TO PUMP FLUID AND CONTROL THEREOF

(71) Applicant: Project Phoenix, LLC, Mesa, AZ (US)

(72) Inventor: Thomas Afshari, Phoenix, AZ (US)

(73) Assignee: Project Phoenix, LLC, Mesa, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/118,167

(22) Filed: Aug. 30, 2018

(65) Prior Publication Data

US 2019/0010964 A1 Jan. 10, 2019

Related U.S. Application Data

(63) Continuation of application No. 14/862,608, filed on Sep. 23, 2015, now Pat. No. 10,072,676, which is a (Continued)

(51) Int. Cl.
*F15B 7/00* (2006.01)
*F04C 2/18* (2006.01)

(Continued)

(52) U.S. Cl.
CPC ..... *F15B 7/006* (2013.01); *F04C 2/18* (2013.01); *F04C 14/08* (2013.01); *F04C 14/24* (2013.01);

(Continued)

(58) Field of Classification Search
CPC .... F16B 9/08; F16B 9/09; F16B 2211/20561; F16H 61/437; F16H 61/438
See application file for complete search history.

(56) References Cited

U.S. PATENT DOCUMENTS 337,551 A 3/1886 Berrenberg et al.
688,616 A 12/1901 Ferguson (Continued)

FOREIGN PATENT DOCUMENTS

CA 2 236 535 A1 11/1999
CA 2 878 316 A1 3/2014

(Continued)

OTHER PUBLICATIONS

Esposito, Fluid Power with Applicators, 7th Ed., Chapter 5, pp. 154-162 (2009).

(Continued)

*Primary Examiner* — Michael Leslie
*Assistant Examiner* — Matthew Wiblin
(74) *Attorney, Agent, or Firm* — Perkins Coie LLP

(57) ABSTRACT

A fluid system includes a variable-speed and/or a variable-torque pump to pump a fluid, at least one proportional control valve assembly, an actuator that is operated by the fluid to control a load, and a controller that establishes a speed and/or torque of the pump and a position of the at least one proportional control valve assembly. The pump includes at least one fluid driver that provides fluid to the actuator, which can be, e.g., a fluid-actuated cylinder, a fluid-driven motor or another type of fluid-driven actuator that controls a load. Each fluid driver includes a prime mover and a fluid displacement assembly. The fluid displacement assembly can be driven by the prime mover such that fluid is transferred from the inlet port to the outlet port of the pump.

20 Claims, 7 Drawing Sheets

Related U.S. Application Data continuation of application No. PCT/US2015/050589, filed on Sep. 17, 2015.

(60) Provisional application No. 62/212,788, filed on Sep. 1, 2015, provisional application No. 62/054,176, filed on Sep. 23, 2014.

(51) Int. Cl.
*F04C 14/08* (2006.01)
*F04C 14/24* (2006.01)
*F04C 2/08* (2006.01)

(52) U.S. Cl.
CPC ..... *F04C 2/088* (2013.01); *F04C 2270/035* (2013.01); *F04C 2270/051* (2013.01); *F15B 2211/20515* (2013.01); *F15B 2211/20538* (2013.01); *F15B 2211/20561* (2013.01); *F15B 2211/212* (2013.01); *F15B 2211/27* (2013.01); *F15B 2211/40515* (2013.01); *F15B 2211/41572* (2013.01); *F15B 2211/426* (2013.01); *F15B 2211/455* (2013.01); *F15B 2211/46* (2013.01); *F15B 2211/505* (2013.01); *F15B 2211/5158* (2013.01); *F15B 2211/526* (2013.01); *F15B 2211/632* (2013.01); *F15B 2211/6313* (2013.01); *F15B 2211/6343* (2013.01); *F15B 2211/6651* (2013.01); *F15B 2211/6653* (2013.01); *F15B 2211/6654* (2013.01); *F15B 2211/7053* (2013.01); *F15B 2211/785* (2013.01)

(56) References Cited

U.S. PATENT DOCUMENTS 1,341,846 A 6/1920 Gollings
1,361,423 A 12/1920 Waterous
1,407,496 A 2/1922 Storey
1,418,741 A 6/1922 Stallman
1,665,120 A 4/1928 Wendell
1,681,796 A 8/1928 Wendell
1,712,157 A 5/1929 Morita
2,439,427 A 4/1948 Guibert et al.
2,572,334 A 10/1951 Guibert
2,601,397 A 6/1952 Hill et al.
2,621,603 A 12/1952 Thomas
2,918,209 A 12/1959 Schueller
2,927,429 A 3/1960 Carlson
2,928,295 A 3/1960 Boulanger
2,937,807 A 5/1960 Lorenz
2,940,661 A 6/1960 Lorenz
3,136,224 A 6/1964 Escobosa
3,264,502 A 8/1966 Lytle et al.
3,585,973 A 6/1971 Klover
3,694,105 A 9/1972 Martin
3,763,746 A 10/1973 Walters
3,922,855 A 12/1975 Bridwell et al.
3,932,993 A 1/1976 Riedhammer
3,979,910 A 9/1976 Leuenberger et al.
4,016,719 A 4/1977 Yavnai
4,030,403 A 6/1977 Elser
4,345,436 A 8/1982 Johnson
4,369,625 A 1/1983 Izumi et al.
4,418,610 A 12/1983 Holtrop
4,529,362 A 7/1985 Ichiryu et al.
4,627,237 A 12/1986 Hutson
4,630,441 A 12/1986 Chamberlain
4,682,939 A 7/1987 Petro
4,696,163 A 9/1987 Glomeau
4,850,812 A 7/1989 Voight
5,026,248 A 6/1991 Hamilton
5,048,294 A 9/1991 Oshina et al.
5,161,957 A 11/1992 Ribaudo
5,197,861 A 3/1993 Maruyama et al.
5,271,719 A 12/1993 Abe et al.
5,295,798 A 3/1994 Maruyama et al.
5,329,216 A 7/1994 Hasegawa
5,708,311 A 1/1998 Claar et al.
5,709,537 A 1/1998 Maruyama et al.
5,767,635 A 6/1998 Steffens et al.
5,767,638 A 6/1998 Wu et al.
5,778,671 A 7/1998 Bloomquist et al.
5,836,746 A 11/1998 Maruyama et al.
6,002,186 A 12/1999 Coutu et al.
6,042,095 A 3/2000 Kuchta
6,048,235 A 4/2000 Kai
6,053,717 A 4/2000 Dixon
6,155,790 A 12/2000 Pyötsiä et al.
6,247,906 B1 6/2001 Pijanowski
6,447,256 B2 9/2002 Bussard
6,447,266 B2 9/2002 Antaki et al.
6,543,223 B2 4/2003 Muschong et al.
6,652,249 B2 11/2003 Kenney et al.
6,796,120 B2 9/2004 Franchet et al.
6,971,463 B2 12/2005 Shore et al.
6,979,185 B2 12/2005 Kaempe
7,000,386 B1 2/2006 Morgan
7,051,526 B2 5/2006 Geiger
7,155,910 B2 1/2007 Last
7,191,593 B1 3/2007 Ho
7,232,292 B2 6/2007 Lopatinsky et al.
7,240,893 B2 6/2007 Komaba et al.
7,281,372 B2 10/2007 Sakai et al.
7,434,395 B2 10/2008 He
7,537,441 B2 5/2009 Iwasaki
7,870,727 B2 1/2011 Mueller et al.
7,927,079 B2 4/2011 Suzuki et al.
8,157,539 B2 4/2012 Hidaka et al.
8,167,589 B2 5/2012 Hidaka et al.
8,448,432 B2 5/2013 Bresie
8,869,924 B2 10/2014 Kim
8,959,905 B2 2/2015 Baltes et al.
9,234,532 B2 1/2016 Vanderlaan et al.
9,670,943 B2 6/2017 Gomm et al.
10,072,676 B2 * 9/2018 Afshari ..... F15B 7/006
2002/0009368 A1 1/2002 Bussard
2003/0077183 A1 4/2003 Franchet et al.
2003/0091448 A1 5/2003 Prampolini
2003/0126981 A1 7/2003 Bridger et al.
2003/0151315 A1 8/2003 Choi et al.
2004/0060430 A1 4/2004 Brinkman
2004/0213680 A1 10/2004 Suzuki et al.
2005/0022523 A1 2/2005 Nagai et al.
2005/0089414 A1 4/2005 Ohman
2005/0144939 A1 7/2005 Mentink et al.
2006/0001202 A1 1/2006 Bauman
2006/0039804 A1 2/2006 Jordan et al.
2006/0156713 A1 7/2006 Kadlicko
2007/0074511 A1 4/2007 Verkuilen
2007/0098576 A1 5/2007 Horng et al.
2007/0101711 A1 5/2007 Debus
2007/0157612 A1 7/2007 He
2007/0166168 A1 7/2007 Vigholm
2008/0010984 A1 1/2008 Arbel et al.
2008/0190104 A1 8/2008 Bresie
2009/0210120 A1 8/2009 Stein
2009/0266934 A1 10/2009 Makino
2009/0297370 A1 12/2009 Moldovan et al.
2010/0247362 A1 9/2010 Koizumi
2010/0264885 A1 10/2010 Olsen et al.
2010/0322805 A1 12/2010 Aregger
2011/0000203 A1 1/2011 Riedel et al.
2011/0017310 A1 1/2011 Eriksson
2011/0030364 A1 2/2011 Persson et al.
2011/0030505 A1 2/2011 Hoyle et al.
2011/0135516 A1 6/2011 Oishi et al.
2011/0209471 A1 9/2011 Vanderlaan et al.
2011/0250082 A1 10/2011 Han et al.
2012/0173027 A1 7/2012 Cheng et al.
2012/0233997 A1 9/2012 Andruch, III et al.
2012/0305603 A1 12/2012 Kwok et al.
2013/0074487 A1 3/2013 Herold et al.
2013/0091833 A1 4/2013 Zhan et al.

(56) References Cited

U.S. PATENT DOCUMENTS

| | | | | |
|---|---|---|---|---|
| 2013/0098015 | A1 | 4/2013 | Opdenbosh | |
| 2013/0098017 | A1 | 4/2013 | Knussman et al. | |
| 2013/0098464 | A1 | 4/2013 | Knussman | |
| 2013/0239558 | A1 | 9/2013 | Shirao | |
| 2013/0298542 | A1 | 11/2013 | Lowman et al. | |
| 2014/0105714 | A1 | 4/2014 | Kim | |
| 2014/0130487 | A1 | 5/2014 | Akiyama et al. | |
| 2014/0174549 | A1 | 6/2014 | Dybing | |
| 2014/0308106 | A1 | 10/2014 | Beschorner | |
| 2014/0366519 | A1 | 12/2014 | Sadamori | |
| 2015/0121860 | A1 | 5/2015 | Hyon | |
| 2015/0275927 | A1 | 10/2015 | Gomm et al. | |
| 2015/0308463 | A1 | 10/2015 | Gomm et al. | |
| 2017/0114807 | A1* | 4/2017 | Afshari | F15B 15/18 |

FOREIGN PATENT DOCUMENTS

| | | | |
|---|---|---|---|
| CH | 625 600 | A5 | 9/1981 |
| CN | 101655087 | A | 2/2018 |
| DE | 1 258 617 | | 1/1968 |
| DE | 1 528 965 | | 10/1969 |
| DE | 3 230 550 | A1 | 1/1984 |
| DE | 3 247 004 | A1 | 6/1984 |
| DE | 3 821 321 | A1 | 12/1989 |
| DE | 10 2008 018407 | A1 | 10/2009 |
| DE | 10 2009 027282 | A1 | 12/2010 |
| DE | 10 2009 028095 | A1 | 2/2011 |
| DE | 10 2009 045028 | A1 | 3/2011 |
| DE | 10 2011 005831 | A1 | 9/2012 |
| DE | 10 2012 102156 | A1 | 10/2012 |
| EP | 0 558 921 | A1 | 9/1993 |
| EP | 0 942 173 | A1 | 9/1999 |
| EP | 1 249 608 | A1 | 10/2002 |
| EP | 1 531 269 | | 5/2005 |
| EP | 1 967 745 | A1 | 9/2008 |
| EP | 2 113 666 | A2 | 11/2009 |
| EP | 2 816 237 | A1 | 12/2014 |
| FR | 2.119.294 | | 8/1972 |
| FR | 2 428 771 | | 1/1980 |
| GB | 270 000 | | 5/1927 |
| GB | 1 081 711 | A | 8/1967 |
| GB | 1 284 551 | | 8/1972 |
| GB | 1 284 552 | | 8/1972 |
| GB | 1 284 553 | | 8/1972 |
| GB | 1 450 436 | | 9/1976 |
| GB | 2 123 089 | A | 1/1984 |
| GB | 2 259 333 | | 3/1993 |
| JP | S59-20590 | A | 2/1984 |
| JP | Hei 11-336671 | A | 12/1999 |
| JP | 2001-011899 | A | 1/2001 |
| JP | 2001-153066 | A | 6/2001 |
| JP | 2002-147370 | A | 5/2002 |
| JP | 2003-088084 | A | 3/2003 |
| JP | 2006-316662 | A | 11/2006 |
| JP | 3 154 210 | U | 10/2009 |
| JP | 2014-009655 | A | 1/2014 |
| JP | 2014-512495 | A | 5/2014 |
| RU | 2284424 | C1 | 9/2006 |
| RU | 2009149035 | A | 8/2011 |
| SU | 857 550 | A | 8/1981 |
| SU | 1 087 705 | A | 4/1984 |
| WO | WO 1991/13256 | A1 | 9/1991 |
| WO | WO 01/073295 | A1 | 10/2001 |
| WO | WO 03/069160 | A1 | 8/2003 |
| WO | WO 2004/071845 | A1 | 8/2004 |
| WO | WO 2008/060681 | A2 | 5/2008 |
| WO | WO 2010/083991 | A2 | 7/2010 |
| WO | WO 2010/097596 | A1 | 9/2010 |
| WO | WO 2011/035971 | A2 | 3/2011 |
| WO | WO 2011/048261 | A1 | 4/2011 |
| WO | WO 2011/072502 | A1 | 6/2011 |
| WO | 2012-122159 | A2 | 9/2012 |
| WO | WO 2013/06902 | A1 | 1/2013 |
| WO | WO 2013/027620 | A1 | 2/2013 |
| WO | WO 2014/060760 | A2 | 4/2014 |
| WO | WO 2014/135284 | A1 | 9/2014 |
| WO | WO 2014/176256 | A1 | 10/2014 |

OTHER PUBLICATIONS

International Search Report and Written Opinion, International Applicatoin No. PCT/US2015/018342 (published as WO 2015/131196), 19 pages (dated Jul. 20, 2015).

International Search Report and Written Opinion, International Application No. PCT/US2015/022484, (published as WO 2015/148662), 9 pages (dated Jun. 9, 2015).

International Search Report and Written Opinion, International Application No. PCT/US2015/027003 (published as WO 2015/164453), 18 pages (dated Nov. 4, 2015).

International Search Report and Written Opinion, International Application No. PCT/US2015/033752 (published as WO 2015/187673), 15 pages (dated Sep. 29, 2015).

International Search Report and Written Opinion, International Application No. PCT/US2015/033764 (published as WO 2015/187681), 7 pages (dated Aug. 19, 2015).

International Search Report and Written Opinion, International Application No. PCT/US2015/033776 (published as WO 2015/187688), 31 pages (dated Oct. 28, 2015).

International Search Report and Written Opinion, International Application No. PCT/US2015/041612 (published as WO 2016/014715), 8 pages (dated Sep. 28, 2015).

International Search Report and Written Opinion, International Application No. PCT/US2015/053670 (published as WO 2015/057321), 10 pages (dated Dec. 16, 2015).

International Search Report and Written Opinion, International Application No. PCT/US2015/054145 (published as WO 2016/064569), 9 pages (dated Feb. 2, 2016).

International Search Report and Written Opinion, International Application No. PCT/US2015/050589 (published as WO 2016/048773), 10 pages (dated Dec. 7, 2015).

International Search Report and Written Opinion, International Application No. PCT/US2016/049959 (published as WO 2017/040825), 10 pages (dated Dec. 9, 2016).

International Search Report and Written Opinion, International Application No. PCT/US2016/049918 (published as WO 2017/040792), 10 pages (dated Nov. 23, 2016).

Marks' Standard Handbook for Mechanical Engineers, Eighth Ed., Section 14, pp. 14-1-14-31 (1978).

Supplementary European Search Report, EP Application No. 15802457.0, 24 pages (dated Mar. 14, 2018).

Supplementary European Search Report, EP Application No. 15803186.4, 9 pages (dated Dec. 19, 2017).

Supplementary European Search Report, EP Application No. 15803994.1, 7 pages (dated Jan. 22, 2018).

Supplemental European Search Report, European Application No. EP 18 20 7568.9 (not yet published), 7 pages (dated Feb. 4, 2019).

Yusof et al., "Slip flow coefficient analysis in water hydrauilics gear pump for environmental friendly application," *IOP Conf. Series: Materials Science and Engineering*, 50:012016 (2013).

U.S. Appl. No. 14/637,064, filed Mar. 3, 2015, now U.S. Pat. No. 9,228,586, Jan. 5, 2016, Pump Integrated With Two Independently Driven Prime Movers.

U.S. Appl. No. 14/862,608, filed Sep. 23, 2015, now U.S. Pat. No. 10,072,676, Sep. 11, 2018, System to Pump Fluid and Control Thereof.

U.S. Appl. No. 14/944,368, filed Nov. 18, 2015, now U.S. Pat. No. 9,920,755, Mar. 20, 2018, Pump Integrated With Two Independently Driven Prime Movers.

U.S. Appl. No. 15/128,269, filed Sep. 22, 2016, System to Pump Fluid and Control Thereof.

U.S. Appl. No. 15/305,579, filed Apr. 22, 2015, Fluid Delivery System With a Shaft Having a Through-Passage.

U.S. Appl. No. 15/315,560, filed Jun. 2, 2015, Hydrostatic Transmission Assembly and System.

U.S. Appl. No. 15/315,572, filed Jun. 2, 2015, Linear Actuator Assembly and System.

(56) References Cited

OTHER PUBLICATIONS

U.S. Appl. No. 15/315,592, filed Jun. 2, 2015, Linear Actuator Assembly and System.
U.S. Appl. No. 15/327,748, filed Jul. 22, 2015, External Gear Pump Integrated With Two Independently Driven Prime Movers.
U.S. Appl. No. 15/517,356, filed Oct. 2, 2015, Linear Actuator Assembly and System.
U.S. Appl. No. 15/520,386, filed Oct. 6, 2015, Hydrostatic Transmission Assembly and System.
U.S. Appl. No. 15/756,928, filed Mar. 1, 2018, System to Pump Fluid and Control Thereof.
U.S. Appl. No. 15/756,942, filed Sep. 1, 2016, System to Pump Fluid and Control Thereof.
U.S. Appl. No. 15/887,856, filed Feb. 2, 2018, Pump Integrated With Two Independently Drive Prime Movers.
U.S. Appl. No. 16/374,456, filed Apr. 3, 2019, Fluid Delivery System With a Shaft Having a Through-Passage.

* cited by examiner

SYSTEM TO PUMP FLUID AND CONTROL THEREOF

PRIORITY

The present application is a continuation of U.S. patent application Ser. No. 14/862,608 filed on Sep. 23, 2015, which is a continuation of International Application No. PCT/US15/50589 filed on Sep. 17, 2015, which claims priority to U.S. Provisional Patent Application No. 62/054,176 filed on Sep. 23, 2014 and U.S. Provisional Patent Application No. 62/212,788 filed on Sep. 1, 2015, which are incorporated herein by reference in their entirety.

TECHNICAL FIELD

The present invention relates generally to various systems that pump fluid and to control methodologies thereof. More particularly, the present invention relates to control of a variable speed and/or a variable torque pump with at least one fluid driver and at least one proportional control valve in the system.

BACKGROUND OF THE INVENTION

Systems in which a fluid is pumped can be found in a variety of applications such as heavy and industrial machines, chemical industry, food industry, medical industry, commercial applications, and residential applications to name just a few. Because the specifics of the pump system can vary depending on the application, for brevity, the background of the invention will be described in terms of a generalized hydraulic system application typically found in heavy and industrial machines. In such machines, hydraulic systems can be used in applications ranging from small to heavy load applications, e.g., excavators, front-end loaders, cranes, and hydrostatic transmissions to name just a few. Depending on the type of system, a conventional machine with a hydraulic system usually includes many parts such as a hydraulic actuator (e.g., a hydraulic cylinder, hydraulic motor, or another type of actuator that performs work on an external load), a hydraulic pump (including a motor and gear assembly), and a fluid reservoir. The motor drives the gear assembly to provide pressurized fluid from the fluid reservoir to the hydraulic actuator, in a predetermined manner. For example, when the hydraulic actuator is a hydraulic cylinder, the hydraulic fluid from the pump causes the piston rod of the cylinder to move within the body of the cylinder. In a case where the hydraulic actuator is a hydraulic motor, the hydraulic fluid from the pump causes the hydraulic motor to, e.g., rotate and drive an attached load.

Typically, the inertia of the hydraulic pump in the above-described industrial applications makes it impractical to vary the speed of the hydraulic pump to precisely control the flow in the system. That is, the prior art pumps in such industrial machines are not very responsive to changes in flow demand. Thus, to control the flow in the system, flow control devices such as a variable-displacement hydraulic pump and/or a directional flow control valve are added to the system and the hydraulic pump is run at a constant speed to ensure that an adequate pressure is always maintained to the flow control devices. The hydraulic pump can be run at full speed or at some other constant speed that ensures that the system always has the required pressure for the flow control devices in the system. However, running the hydraulic pump at full speed or at some other constant speed is inefficient as it does not take into account the true energy input requirements of the system. For example, the pump will run at full speed even when the system load is only at 50%. In addition, the flow control devices in these systems typically use hydraulic controls to operate, which can be relatively complex and require additional hydraulic fluid to function.

Because of the complexity of the hydraulic circuits and controls, these hydraulic systems are typically open-loop in that the pump draws the hydraulic fluid from a large fluid reservoir and the hydraulic fluid is sent back to the reservoir after performing work on the hydraulic actuator and after being used in the hydraulic controls. That is, the hydraulic fluid output from the hydraulic actuator and the hydraulic controls is not sent directly to the inlet of the pump as in a closed-loop system. An open-loop system with a large fluid reservoir is needed in these systems to maintain the temperature of the hydraulic fluid to a reasonable level and to ensure that there is an adequate supply of hydraulic fluid for the pump to prevent cavitation and for operating the various hydraulically-controlled components. While closed-loop circuits are known, these tend to be for simple systems where the risk of pump cavitation is minimal. In open-loop systems, however, the various components are often located spaced apart from one another. To interconnect these parts, various additional components like connecting shafts, hoses, pipes, and/or fittings are used in a complicated manner and thus susceptible to contamination. Moreover, these components are susceptible to damage or degradation in harsh working environments, thereby causing increased machine downtime and reduced reliability of the machine. Thus, known systems have undesirable drawbacks with respect to complexity and reliability of the systems.

Further limitation and disadvantages of conventional, traditional, and proposed approaches will become apparent to one skilled in the art, through comparison of such approaches with embodiments of the present invention as set forth in the remainder of the present disclosure with reference to the drawings.

SUMMARY OF THE INVENTION

Preferred embodiments of the present invention provide for faster and more precise control of the fluid flow and/or pressure in systems that use a variable-speed and/or a variable-torque pump. The fluid pumping system and method of control thereof discussed below are particularly advantageous in a closed-loop type system since the faster and more precise control of the fluid flow and/or the pressure in such systems can mean smaller accumulator sizes and a reduced risk of pump cavitation than in conventional systems. In an exemplary embodiment, a fluid system includes a variable-speed and/or a variable-torque pump, at least one proportional control valve assembly, an actuator that is operated by the fluid to control a load, and a controller to concurrently establish a speed and/or torque of the pump and an opening of the at least one proportional control valve assembly. The pump includes at least one fluid driver that provides fluid to the actuator, which can be, e.g., a fluid-actuated cylinder, a fluid-driven motor or another type of fluid-driven actuator that controls a load (e.g., a boom of an excavator, a hydrostatic transmission, or some other equipment or device that can be operated by an actuator). As used herein, "fluid" means a liquid or a mixture of liquid and gas containing mostly liquid with respect to volume. Each fluid driver includes a prime mover and a fluid displacement assembly. The fluid displacement assembly can be driven by the prime mover such that fluid is transferred from the inlet port to the outlet port of the pump. In some embodiments, a proportional control valve assembly is disposed between the pump outlet and an inlet port of the actuator. The proportional control valve assembly can include a proportional control valve and a valve actuator. In some embodiments, the proportional control valve assembly is disposed between an outlet port of the actuator and the pump inlet. In other embodiments, the system includes two proportional control valve assemblies with one valve assembly disposed between the pump outlet and actuator inlet port and the other valve assembly disposed between the actuator outlet port and the pump inlet. The controller concurrently establishes a speed and/or a torque of the prime mover and an opening of a proportional control valve in at least one proportional control valve assembly so as to control a flow and/or a pressure in the fluid system.

In some embodiments, the fluid displacement assembly includes a first fluid displacement member and a second fluid displacement member. The first fluid displacement member is driven by the prime mover and when driven, the first displacement member drives the second fluid displacement member. When driven, the first and second fluid displacement members transfer fluid from an inlet of the pump to an outlet of the pump. Depending on the design, one or both of the fluid displacement members can work in combination with a fixed element, e.g., pump wall, crescent, or another similar component, when transferring the fluid. The first and second fluid displacement members can be, e.g., an internal or external gear with gear teeth, a hub (e.g. a disk, cylinder, or other similar component) with projections (e.g. bumps, extensions, bulges, protrusions, other similar structures or combinations thereof), a hub (e.g. a disk, cylinder, or other similar component) with indents (e.g., cavities, depressions, voids or similar structures), a gear body with lobes, or other similar structures that can displace fluid when driven.

In some embodiments, the pump includes two fluid divers with each fluid driver including a prime mover and a fluid displacement assembly, which includes a fluid displacement member. The fluid displacement member in each fluid driver is independently driven by the respective prime mover. Each fluid displacement member has at least one of a plurality of projections and a plurality of indents. That is, as in the above embodiment, each fluid displacement member can be, e.g., an internal or external gear with gear teeth, a hub (e.g. a disk, cylinder, or other similar component) with projections (e.g. bumps, extensions, bulges, protrusions, other similar structures or combinations thereof), a hub (e.g. a disk, cylinder, or other similar component) with indents (e.g., cavities, depressions, voids or similar structures), a gear body with lobes, or other similar structures that can displace fluid when driven. The configuration of the fluid displacement members in the pump need not be identical. For example, one fluid displacement member can be configured as an external gear-type fluid displacement member and another fluid displacement member can be configured as an internal gear-type fluid displacement member. The fluid displacement members are independently operated, e.g., by an electric motor, a hydraulic motor or other fluid-driven motor, an internal-combustion, gas or other type of engine, or other similar device that can independently operate its fluid displacement member. "Independently operate," "independently operated," "independently drive" and "independently driven" means each fluid displacement member, e.g., a gear, is operated/driven by its own prime mover, e.g., an electric motor, in a one-to-one configuration. However, the fluid drivers are operated by a controller such that contact between the fluid drivers is synchronized, e.g., in order to pump the fluid and/or seal a reverse flow path. That is, along with concurrently establishing the speed and/or torque of the prime mover and an opening of a proportional control valve in at least one proportional control valve assembly, operation of the independently operated fluid drivers is synchronized by the controller such that the fluid displacement member in each fluid driver makes synchronized contact with another fluid displacement member. The contact can include at least one contact point, contact line, or contact area.

Another exemplary embodiment includes a system that has a hydraulic pump, at least one proportional control valve assembly, and a controller. The hydraulic pump provides hydraulic fluid to a hydraulic actuator. In some embodiments, the hydraulic actuator is a hydraulic cylinder and in other embodiments the hydraulic actuator is a hydraulic motor. Of course, the present invention is not limited to just these examples and other types of hydraulic actuators that operate a load can be used. The hydraulic pump includes at least one motor and a gear assembly. The gear assembly can be driven by the at least one motor such that fluid is transferred from the inlet of the pump to the outlet of the pump. Each proportional control valve assembly includes a proportional control valve and a valve actuator to operate the proportional control valve. In some embodiments, a proportional control valve is disposed between the pump outlet and the hydraulic actuator inlet. In some embodiments, the proportional control valve is disposed between the hydraulic actuator outlet and the pump inlet. In still other embodiments, the hydraulic system can include two proportional control valves. In this embodiment, one of the proportional control valves can be disposed between the pump outlet and the hydraulic actuator inlet, and the other proportional control valve can be disposed between the hydraulic actuator outlet and the pump inlet. The controller concurrently establishes a speed and/or a torque of the at least one motor and an opening of the proportional control valve or valves so as to control a flow and/or a pressure in the hydraulic system.

The summary of the invention is provided as a general introduction to some embodiments of the invention, and is not intended to be limiting to any particular fluid system or hydraulic system configuration. It is to be understood that various features and configurations of features described in the Summary can be combined in any suitable way to form any number of embodiments of the invention. Some additional example embodiments including variations and alternative configurations are provided herein.

BRIEF DESCRIPTION OF THE DRAWINGS

The accompanying drawings, which are incorporated herein and constitute part of this specification, illustrate exemplary embodiments of the invention, and, together with the general description given above and the detailed description given below, serve to explain the features of the preferred embodiments of the invention.

DETAILED DESCRIPTION OF THE PREFERRED EMBODIMENTS

Exemplary embodiments of the present invention are directed to systems in which fluid is pumped using a variable-speed and/or a variable-torque pump and at least one proportional control valve. The operation of the pump and the at least one proportional control valve is coordinated to provide for faster and more precise control of the fluid flow and/or the pressure than in conventional systems. As discussed in further detail below various exemplary embodiments include pump configurations in which a prime mover drives a fluid displacement assembly that can have one or more fluid displacement members. In some exemplary embodiments, the fluid displacement assembly has two displacement members and the prime mover drives one fluid displacement member which in turn drives the another fluid displacement member (a driver-driven configuration). In some exemplary embodiments, the pump includes more than one fluid driver with each fluid driver having a prime mover and a fluid displacement member. The fluid displacement members are independently driven by the respective prime movers so as to synchronize contact between the respective fluid displacement members (drive-drive configuration). In some embodiments, the synchronized contact provides a slip coefficient in a range of 5% or less.

Figure 1:
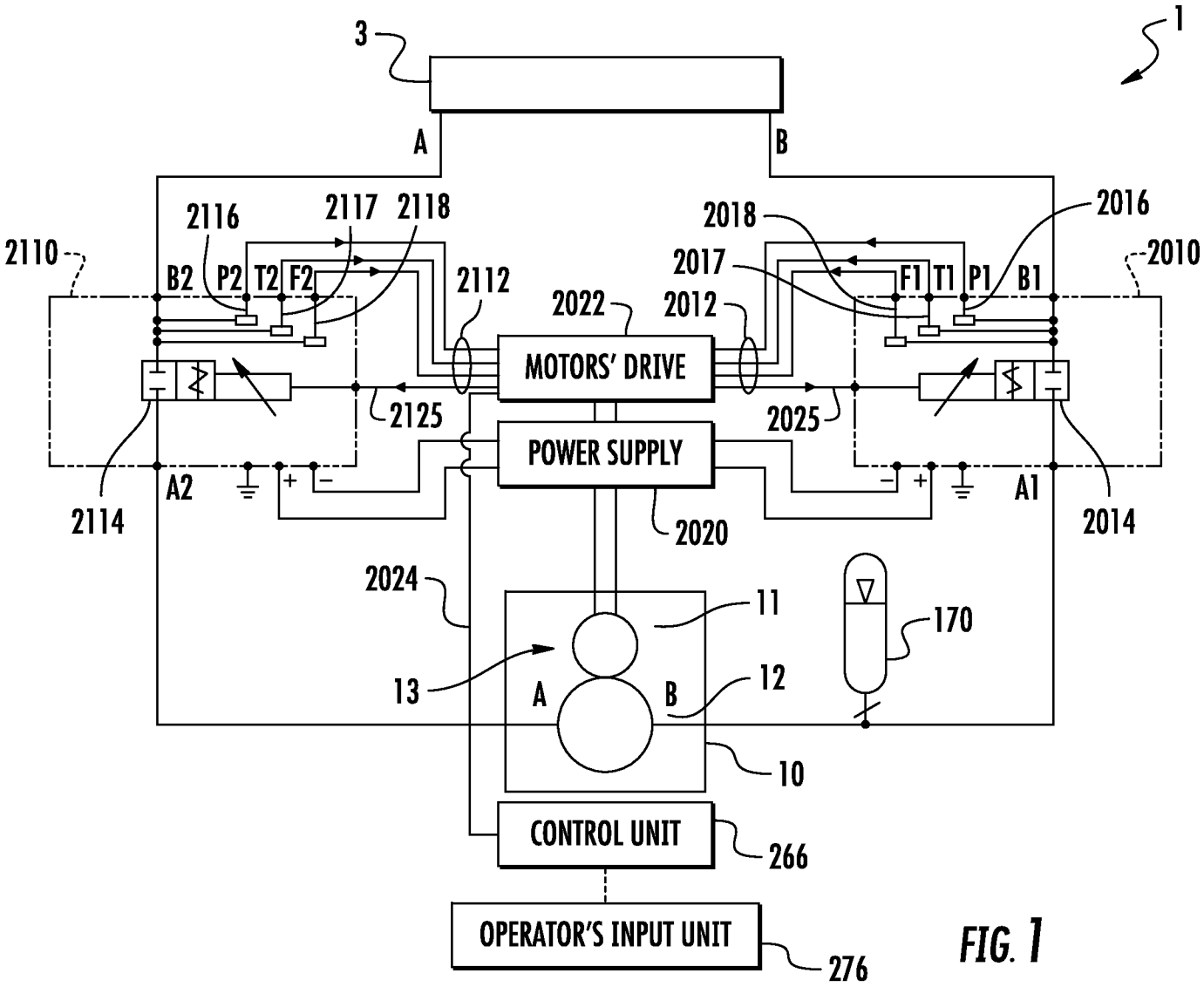
FIG. 1 is a schematic diagram illustrating an exemplary embodiment of a fluid system.

FIG. 1 illustrates an exemplary embodiment of a fluid system. For purposes of brevity, the fluid system will be described in terms of an exemplary hydraulic system application. However, those skilled in the art will understand that the concepts and features described below are also applicable to systems that pump other (non-hydraulic) types of fluids. The hydraulic system 1 includes a hydraulic pump 10 providing hydraulic fluid to a hydraulic actuator 3, which can be a hydraulic cylinder, a hydraulic motor, or another type of fluid-driven actuator that performs work on an external load. The hydraulic system 1 also includes proportional control valve assemblies 2010 and 2110. However, in some embodiments, the system 1 can be designed to include only one of the proportional control valve assemblies 2010 and 2110. The hydraulic system 1 can include an accumulator 170. The proportional control valve assembly 2010 is disposed between port B of the hydraulic pump 10 and port B of the hydraulic actuator 3, i.e., the valve assembly 2010 is in fluid communication with port B of the hydraulic pump 10 and port B of the hydraulic actuator 3. The control valve assembly 2110 is disposed between port A of the hydraulic pump 10 and port A of the hydraulic actuator 3, i.e., the control valve assembly 2110 is in fluid communication with port A of the hydraulic pump 10 and port A of the hydraulic actuator 3.

In an exemplary embodiment, the pump 10 is a variable speed, variable torque pump. In some embodiments, the hydraulic pump 10 is bi-directional. The hydraulic pump 10 includes fluid driver 13 that has a prime mover 11 and a fluid displacement assembly 12. The prime mover may be, e.g., by an electric motor, a hydraulic motor or other fluid-driven motor, an internal-combustion, gas or other type of engine, or other similar device that can independently operate its fluid displacement member. In the exemplary embodiment of FIG. 1, a single fluid driver 13 is illustrated. However, pump 10 can have more than one fluid driver. In some embodiments, each fluid driver includes a prime mover 11 and a fluid displacement assembly 12. In the exemplary embodiment, the fluid displacement assembly 12 has a fluid displacement member, which displaces fluid when driven by the prime mover 11. The fluid displacement member can be, e.g., a hub (e.g. a disk, cylinder, or other similar component) with projections (e.g. bumps, extensions, bulges, protrusions, other similar structures or combinations thereof), a hub (e.g. a disk, cylinder, or other similar component) with indents (e.g., cavities, depressions, voids or similar structures), a gear body with lobes, or other similar structures that can displace fluid when driven. The prime mover 11 is controlled by the control unit 266 via the drive unit 2022, and the prime mover 11 drives the fluid displacement assembly 12. In some embodiments, the prime mover 11 is bi-directional. The exemplary embodiment of FIG. 1 includes two proportional control valve assemblies 2010, 2110. Each valve assembly 2010, 2110 includes a proportional control valve 2014, 2114, respectively. The control valves 2014, 2114 are also controlled by the control unit 266 via the drive unit 2022. The control valves 2014, 2114 can be commanded to go full open, full closed, or throttled between 0% and 100% by the control unit 266 via the drive unit 2022 using the corresponding communication connection 2025, 2125. In some embodiments, the control unit 266 can communicate directly with each control valve assembly 2010, 2110 and the hydraulic pump 10. A common power supply 2020 can provide power to the control valve assemblies 2010, 2110 and the hydraulic pump 10. In some embodiments, the control valve assemblies 2010, 2110 and the hydraulic pump 10 have separate power supplies.

The drive unit 2022 includes hardware and/or software that interprets the command signals from the control unit 266 and sends the appropriate demand signals to the prime mover 11 and/or valves 2014, 2114. For example, the drive unit 2022 can include pump curves and/or prime mover curves (e.g., motor curves if the prime mover is an electric motor) that are specific to the hydraulic pump 10 such that command signals from the control unit 266 will be converted to an appropriate speed/torque demand signals to the hydraulic pump 10 based on the design of the hydraulic pump 10. Similarly, the drive unit 2022 can include valve curves and/or valve actuator curves that are specific to the control valves 2014, 2114 and the command signals from the control unit 266 will be converted to the appropriate demand signals based on the type of valve. The pump/prime mover curves and the valve/actuator curves can be implemented in hardware and/or software, e.g., in the form of hardwire circuits, software algorithms and formulas, or a combination thereof.

In some embodiments, the drive unit 2022 can include application specific hardware circuits and/or software (e.g., algorithms or any other instruction or set of instructions to perform a desired operation) to control the prime mover 11 and/or control valves 2014, 2114. For example, in some applications, the hydraulic actuator 3 can be a hydraulic cylinder installed on a boom of an excavator. In such an exemplary system, the drive unit 2022 can include circuits, algorithms, protocols (e.g., safety, operational), look-up tables, etc. that are specific to the operation of the boom. Thus, a command signal from the control unit 266 can be interpreted by the drive unit 2022 to appropriately control the prime mover 11 and/or control valves 2014, 2114 to position the boom at a desired positon.

The control unit 266 can receive feedback data from the prime mover 11. For example, depending on the type of prime mover the control unit 266 can receive prime mover revolution per minute (rpm) values, speed values, frequency values, torque values, current and voltage values, and/or other data related to an operation of a prime mover. In addition, the control unit 266 can receive feedback data from the control valves 2014, 2114. For example, the control unit 266 can receive the open and close status and/or the percent opening status of the control valves 2014, 2114. In addition, depending on the type of valve actuator, the control unit 266 can receive feedbacks such as speed and/or position of the actuator. Further, the control unit 266 can receive feedback of process parameters such as pressure, temperature, flow, or other parameters related to the operation of the system 1. For example, each control valve assembly 2010, 2110 can have sensors (or transducers) 2016-2018, 2116-2118, respectively, to measure process parameters such as pressure, temperature, and flow rate of the hydraulic fluid. The sensors 2016-2018, 2116-2118 can communicate with control unit 266/drive unit 2022 via communication connections 2012, 2112, respectively. The sensors 2016-2018, 2116-2118 can be either on the upstream side or on the downstream side of the proportional control valves 2014, 2114, as desired. In some embodiments, two sets of sensors are provided for any one or each of the proportional control valves 2014, 2114 where one set of sensors are disposed on the upstream side and the other set are disposed on the downstream side. Alternatively, or in addition to sensors 2016-2018, 2116-2118 or the additional set of sensors, the hydraulic system 1 can have other sensors throughout the system to measure process parameters such as, e.g., pressure, temperature, flow, or other parameters related to the operation of the system 1.

Turning to FIG. 1, although the drive unit 2022 and control unit 266 are shown as separate controllers, the functions of these units can be incorporated into a single controller or further separated into multiple controllers (e.g., if there are multiple fluid drivers and thus multiple prime movers, the prime movers can have a common controller and/or each prime mover can have its own controller and/or the control valves 2014, 2114, can have a common controller and/or each control valve can have its own controller). The controllers (e.g., control unit 266, drive unit 2022 and/or other controllers) can communicate with each other to coordinate the operation of the control valve assemblies 2010, 2110 and the hydraulic pump 10. For example, as illustrated in FIG. 1, the control unit 266 communicates with the drive unit 2022 via a communication connection 2024. The communications can be digital based or analog based (or a combination thereof) and can be wired or wireless (or a combination thereof). In some embodiments, the control system can be a "fly-by-wire" operation in that the control and sensor signals between the control unit 266, the drive unit 2022, the control valve assemblies 2010, 2110, hydraulic pump 10, sensors 2016-2018, 2116-2118 are entirely electronic or nearly all electronic. That is, in the case of hydraulic systems, the control system does not use hydraulic signal lines or hydraulic feedback lines for control, e.g., the control valves 2014, 2114 do not have hydraulic connections for pilot valves. In some systems, a combination of electronic and hydraulic controls can be used.

The control unit 266 can receive inputs from an operator's input unit 276. Using the input unit 276, the operator can manually control the system or select pre-programmed routines. For example, the operator can select a mode of operation for the system such as flow (or speed) mode, pressure (or torque) mode, or a balanced mode. Flow or speed mode can be utilized for an operation where relatively fast response of the actuator 3 with a relatively low torque requirement is required, e.g., a relatively fast retraction or extraction of a piston rod in a hydraulic cylinder, a fast rpm response in a hydraulic motor, or any other scenario in any type of application where a fast response of the actuator is required. Conversely, a pressure or torque mode can be utilized for an operation where a relatively slow response of the actuator 3 with a relatively high torque requirement is required. Based on the mode of operation selected, the control scheme for controlling the prime mover 11 and the control valves 2014, 2114 can be different. That is, depending on the desired mode of operation, e.g., as set by the operator or as determined by the system based on the application (e.g., a hydraulic boom application or another type of hydraulic application), the flow and/or pressure to the hydraulic actuator 3 can be controlled to a desired set-point value by controlling either the speed or torque of the prime mover 11 and/or the positon of control valves 2014, 2114. The operation of the control valves 2014, 2114 and prime mover 11 are coordinated such that both the percent opening of the control valves 2014, 2114 and the speed/torque of the prime mover 11 are appropriately controlled to maintain a desired flow/pressure in the system. For example, in a flow (or speed) mode operation, the control unit 266/drive unit 2022 controls the flow in the system by controlling the speed of the prime mover 11 in combination with the positon of the control valves 2014, 2114, as described below. When the system is in a pressure (or torque) mode operation, the control unit 266/drive unit 2022 controls the pressure at a desired point in the system, e.g., at port A or B of the hydraulic actuator 3, by adjusting the torque of the prime mover 11 in combination with the positon of the control valves 2014, 2114, as described below. When the system is in a balanced mode of operation, the control unit 266/drive unit 2022 takes both the system's pressure and hydraulic flow rate into account when controlling the prime mover 11 and control valves 2014, 2114.

The use of control valves 2014, 2114 in combination with controlling the prime mover 11 provides for greater flexibility. For example, the combination of control valves 2014, 2114 and prime mover 11 provides for faster and more precise control of the hydraulic system flow and pressure than with the use of a hydraulic pump alone. When the system requires an increase or decrease in the flow, the control unit 266/drive unit 2022 will change the speeds of the prime mover 11 accordingly. However, due to the inertia of the hydraulic pump 10 and the hydraulic system 1, there can be a time delay between when the new flow demand signal is received by the prime mover 11 and when there is an actual change in the fluid flow. Similarly, in pressure/torque mode, there can also be a time delay between when the new pressure demand signal is sent and when there is an actual change in the system pressure. When fast response times are required, the control valves 2014, 2114 allow for the hydraulic system 1 to provide a near instantaneous response to changes in the flow/pressure demand signal. In some systems, the control unit 266 and/or the drive unit 2022 can determine and set the proper mode of operation (e.g., flow mode, pressure mode, balanced mode) based on the application and the type of operation being performed. In some embodiments, the operator initially sets the mode of operation but the control unit 266/drive unit 2022 can override the operator setting based on, e.g., predetermined operational and safety protocols. As indicated above, the control of hydraulic pump 10 and control valve assemblies 2010, 2110 will vary depending on the mode of operation.

In pressure/torque mode operation, the power output the prime mover 11 is determined based on the system application requirements using criteria such as maximizing the torque of the prime mover 11. If the hydraulic pressure is less than a predetermined set-point at, for example, port A of the hydraulic actuator 3, the control unit 266/drive unit 2022 will increase the prime mover's torque to increase the hydraulic pressure, e.g., if the prime mover is an electric motor, the motor's current (and thus the torque) is increased. Of course, the method of increasing the torque will vary depending on the type of prime mover. If the pressure at port A of the hydraulic actuator 3 is higher than the desired pressure, the control unit 266/drive unit 2022 will decrease the torque from the prime mover, e.g., if the prime mover is an electric motor, the motor's current (and thus the torque) is decreased to reduce the hydraulic pressure. While the pressure at port A of the hydraulic actuator 3 is used in the above-discussed exemplary embodiment, pressure mode operation is not limited to measuring the pressure at that location or even a single location. Instead, the control unit 266/drive unit 2022 can receive pressure feedback signals from any other location or from multiple locations in the system for control. Pressure mode operation can be used in a variety of applications.

For example, if the hydraulic actuator 3 is a hydraulic cylinder and there is a command to extend (or extract) the hydraulic cylinder, the control unit 266/drive unit 2022 will determine that an increase in pressure at the inlet to the extraction chamber of the hydraulic cylinder (e.g., port A of the hydraulic actuator 3) is needed and will then send a signal to the prime mover 11 and to the control valves 2014, 2114 that results in a pressure increase at the inlet to the extraction chamber. Similarly, if the hydraulic actuator 3 is a hydraulic motor and there is a command to increase the speed of the hydraulic motor, the control unit 266/drive unit 2022 will determine that an increase in pressure at the inlet to the hydraulic motor (e.g., port A of the hydraulic actuator 3) is needed and will then send a signal to the prime mover 11 and to the control valves 2014, 2114 that results in a pressure increase at the inlet to the hydraulic motor.

In pressure/torque mode operation, the demand signal to the hydraulic pump 10 will increase the current to the prime mover 11 driving the fluid displacement assembly 12 of the hydraulic pump 10, which increases the torque. However, as discussed above, there can be a time delay between when the demand signal is sent and when the pressure actually increases at, e.g., port A of the hydraulic actuator 3 (which can be, e.g., the inlet to the extraction chamber of a hydraulic cylinder, the inlet to the hydraulic motor, or an inlet to another type of hydraulic actuator). To reduce or eliminate this time delay, the control unit 266/drive unit 2022 will also concurrently send (e.g., simultaneously or near simultaneously) a signal to one or both of the control valves 2014, 2114 to further open (i.e. increase valve opening). Because the reaction time of the control valves 2014, 2114 is faster than that of the prime mover 11 due to the control valves 2014, 2114 having less inertia, the pressure at the hydraulic actuator 3 will immediately increase as one or both of the control valves 2014, 2114 starts to open further. For example, if port A of the hydraulic pump 10 is the discharge of the pump 10, the control valve 2114 can be operated to immediately control the pressure at port A of the hydraulic actuator 3 to a desired value. During the time the control valve 2114 is being controlled, the prime mover 11 will be increasing the pressure at the discharge of the hydraulic pump 10. As the pressure increases, the control unit 266/drive unit 2022 will make appropriate corrections to the control valve 2114 to maintain the desired pressure at port A of the hydraulic actuator 3.

In some embodiments, the control valve 2014, 2114 downstream of the hydraulic pump 10, i.e., the valve on the discharge side, will be controlled while the valve on the upstream side remains at a constant predetermined valve opening, e.g., the upstream valve can be set to 100% open (or near 100% or considerably high percent of opening) to minimize fluid resistance in the hydraulic lines. In the above example, the control unit 266/drive unit 2022 can throttle (or control) the control valve 2114 (i.e. downstream valve) while maintaining the control valve 2014 (i.e. upstream valve) at a constant valve opening, e.g., 100% open. In some embodiments, one or both of the control valves 2014, 2114 can also be controlled to eliminate or reduce instabilities in the hydraulic system 1. For example, as the hydraulic actuator 3 is used to operate a load, the load could cause flow or pressure instabilities in the hydraulic system 1 (e.g., due to mechanical problems in the load, a shift in the weight of the load, or for some other reason). The control unit 266/drive unit 2022 can be configured to control the control valves 2014, 2114 to eliminate or reduce the instability. For example, if, as the pressure is being increased to the hydraulic actuator 3, the actuator 3 starts to act erratically (e.g., the cylinder starts moving too fast, the rpm of the hydraulic motor is too fast, or some other erratic behavior) due to an instability in the load, the control unit 266/drive unit 2022 can be configured to sense the instability based on the pressure and flow sensors and to close one or both of the control valves 2014, 2114 appropriately to stabilize the hydraulic system 1. Of course, the control unit 266/drive unit 2022 can be configured with safeguards so that the upstream valve does not close so far as to starve the hydraulic pump 10.

In some situations, the pressure at the hydraulic actuator 3 (e.g., at port A) is higher than desired. For example, in a case where the hydraulic actuator 3 is a hydraulic cylinder, a higher than desired pressure could mean that the cylinder will extend or retract too fast or the cylinder will extend or retract when it should be stationary, or in a case where the hydraulic actuator 3 is a hydraulic motor, a higher than desired pressure could mean that the hydraulic motor rpm will be too high. Of course, in other types of applications and/or situations a higher than desired pressure could lead to other undesired operating conditions. In such cases, the control unit 266/drive unit 2022 can determine that there is too much pressure at the appropriate port of the hydraulic actuator 3. If so, the control unit 266/drive unit 2022 will determine that a decrease in pressure at the appropriate port of the hydraulic actuator 3 is needed and will then send a signal to the prime mover 11 and to the control valves 2014, 2114 that results in a pressure decrease. The demand signal to the hydraulic pump 10 will decrease the current to the prime mover 11 driving the fluid displacement assembly 12 of the hydraulic pump 10, which decreases the torque. However, as discussed above, there can be a time delay between when the demand signal is sent and when the pressure at the hydraulic cylinder 3 actually decreases. To reduce or eliminate this time delay, the control unit 266/drive unit 2022 will also concurrently send (e.g., simultaneously or near simultaneously) a signal to one or both of the control valves 2014, 2114 to further close (i.e. decrease valve opening). Because the reaction time of the control valves 2014, 2114 will be faster than that of the prime mover 11 due to the control valves 2014, 2114 having less inertia, the pressure at the appropriate port of the hydraulic actuator 3 will immediately decrease as one or both of the control valves 2014, 2114 starts to close. As the pump discharge pressure starts to decrease, one or both of the control valves 2014, 2114 will start to open to maintain the desired pressure at the appropriate port of the hydraulic actuator 3.

In flow/speed mode operation, the power to the prime mover 11 is determined based on the system application requirements using criteria such as how fast the prime mover 11 ramps to the desired speed and how precisely the prime mover speed can be controlled. Because the fluid flow rate is proportional to the speed of prime mover 11 and the fluid flow rate determines an operation of the hydraulic actuator 3 (e.g., the travel speed of the cylinder if the hydraulic actuator 3 is a hydraulic cylinder, the rpm if the hydraulic actuator 3 is a hydraulic motor, or another appropriate parameter depending on the type of system and type of load), the control unit 266/drive unit 2022 can be configured to control the operation of the hydraulic actuator 3 based on a control scheme that uses the speed of prime mover 11, the flow rate, or some combination of the two. That is, when, e.g., a specific response time of hydraulic actuator 3 is required, e.g., a specific travel speed for the hydraulic cylinder, a specific rpm of the hydraulic motor, or some other specific response of hydraulic actuator 3, the control unit 266/drive unit 2022 can control the prime mover 11 to achieve a predetermined speed and/or a predetermined hydraulic flow rate that corresponds to the desired specific response of hydraulic actuator 3. For example, the control unit 266/drive unit 2022 can be set up with algorithms, look-up tables, datasets, or another software or hardware component to correlate the operation of the hydraulic actuator 3 (e.g., travel speed of a hydraulic cylinder, the rpm of a hydraulic motor, or some other specific response) to the speed of the hydraulic pump 10 and/or the flow rate of the hydraulic fluid in the system 1. Thus, the control unit 266/drive unit 2022 can be set up to control either the speed of the prime mover 11 or the hydraulic flow rate in the system to achieve the desired operation of the hydraulic actuator 3.

If the control scheme uses the flow rate, the control unit 266/drive unit 2022 can receive a feedback signal from a flow sensor, e.g., flow sensor 2118 or 2018 or both, to determine the actual flow in the system. The flow in the system can be determined by measuring, e.g., the differential pressure across two points in the system, the signals from an ultrasonic flow meter, the frequency signal from a turbine flow meter, or some other flow sensor/instrument. Thus, in systems where the control scheme uses the flow rate, the control unit 266/drive unit 2022 can control the flow output of the hydraulic pump 10 to a predetermined flow set-point value that corresponds to the desired operation of the hydraulic actuator 3 (e.g., the travel speed if the hydraulic actuator 3 is a hydraulic cylinder, the rpm if the hydraulic actuator 3 is a hydraulic motor, or another appropriate parameter depending on the type of system and type of load).

Similarly, if the control scheme uses the speed of prime mover 11, the control unit 266/drive unit 2022 can receive speed feedback signal(s) from the prime mover 11 or fluid displacement assembly 12. For example, the actual speed of the prime mover 11 can be measured by sensing the rotation of the fluid displacement member. For example, if the fluid displacement member is a gear, the hydraulic pump 10 can include a magnetic sensor (not shown) that senses the gear teeth as they rotate. Alternatively, or in addition to the magnetic sensor (not shown), one or more teeth can include magnets that are sensed by a pickup located either internal or external to the hydraulic pump casing. Of course the magnets and magnetic sensors can be incorporated into other types of fluid displacement members and other types of speed sensors can be used. Thus, in systems where the control scheme uses the flow rate, the control unit 266/drive unit 2022 can control the actual speed of the hydraulic pump 10 to a predetermined speed set-point that corresponds to the desired operation of the hydraulic actuator 3.

If the system is in flow mode operation and the application requires a predetermined flow to hydraulic actuator 3 (e.g., to move a hydraulic cylinder at a predetermined travel speed, to run a hydraulic motor at a predetermined rpm, or some other appropriate operation of the actuator 3 depending on the type of system and the type of load), the control unit 266/drive unit 2022 will determine the required flow that corresponds to the desired hydraulic flow rate. If the control unit 266/drive unit 2022 determines that an increase in the hydraulic flow is needed, the control unit 266/drive unit 2022 and will then send a signal to the hydraulic pump 10 and to the control valves 2014, 2114 that results in a flow increase. The demand signal to the hydraulic pump 10 will increase the speed of the prime mover 11 to match a speed corresponding to the required higher flow rate. However, as discussed above, there can be a time delay between when the demand signal is sent and when the flow actually increases. To reduce or eliminate this time delay, the control unit 266/drive unit 2022 will also concurrently send (e.g., simultaneously or near simultaneously) a signal to one or both of the control valves 2014, 2114 to further open (i.e. increase valve opening). Because the reaction time of the control valves 2014, 2114 will be faster than that of the prime mover 11 due to the control valves 2014, 2114 having less inertia, the hydraulic fluid flow in the system will immediately increase as one or both of the control valves 2014, 2114 starts to open. The control unit 266/drive unit 2022 will then control the control valves 2014, 2114 to maintain the required flow rate. During the time the control valves 2014, 2114 are being controlled, the prime mover 11 will be increasing its speed to match the higher speed demand from the control unit 266/drive unit 2022. As the speed of the prime mover 11 increases, the flow will also increase. However, as the flow increases, the control unit 266/drive unit 2022 will make appropriate corrections to the control valves 2014, 2114 to maintain the required flow rate, e.g., in this case, the control unit 266/drive unit 2022 will start to close one or both of the control valves 2014, 2114 to maintain the required flow rate.

In some embodiments, the control valve 2014, 2114 downstream of the hydraulic pump 10, i.e., the valve on the discharge side, will be controlled while the valve on the upstream side remains at a constant predetermined valve opening, e.g., the upstream valve can be set to 100% open (or near 100% or considerably high percent of opening) to minimize fluid resistance in the hydraulic lines. In the above example, the control unit 266/drive unit 2022 throttles (or controls) the control valve 2114 (i.e. downstream valve) while maintaining control valve 2014 (i.e. upstream valve) at a constant valve opening, e.g., 100% open (or near 100% or considerably high percent of opening). Similar to the pressure mode operation discussed above, in some embodiments, one or both of the control valves 2014, 2114 can also be controlled to eliminate or reduce instabilities in the hydraulic system 1 as discussed above.

In some situations, the flow to the hydraulic cylinder 3 is higher than desired. For example, in the case where the hydraulic actuator 3 is a hydraulic cylinder, a higher than desired flow can mean the cylinder will extend or retract too fast or the cylinder is extend or retract when it should be stationary, or in the case where the hydraulic actuator 3 is a hydraulic motor, a higher than desired flow can mean the motor rpm will be too high. Of course, in other types of applications and/or situations a higher than desired flow could lead to other undesired operating conditions. In such cases, the control unit 266/drive unit 2022 can determine that the flow to the corresponding port of hydraulic actuator 3 is too high. If so, the control unit 266/drive unit 2022 will determine that a decrease in flow to the hydraulic actuator 3 is needed and will then send a signal to the hydraulic pump 10 and to the control valves 2014, 2114 to decrease flow. The demand signal to the hydraulic pump 10 will decrease the speed of the prime mover 11 to match a speed corresponding to the required lower flow rate. However, as discussed above, there can be a time delay between when the demand signal is sent and when the flow actually decreases. To reduce or eliminate this time delay, the control unit 266/drive unit 2022 will also concurrently send (e.g., simultaneously or near simultaneously) a signal to at least one of the control valves 2014, 2114 to further close (i.e. decrease valve opening). Because the reaction time of the control valves 2014, 2114 will be faster than that of the prime mover 11 due to the control valves 2014, 2114 having less inertia, the system flow will immediately decrease as the control valve(s) 2014, 2114 starts to close. As the speed of the prime mover 11 starts to decrease, the flow will also start to decrease. However, the control unit 266/drive unit 2022 will appropriately control the control valves 2014, 2114 to maintain the required flow (i.e., the control unit 266/drive unit 2022 will start to open one or both of the control valves 2014, 2114 as the prime mover speed decreases). For example, the downstream valve with respect to the hydraulic pump 10 can be throttled to control the flow to a desired value while the upstream valve is maintained at a constant value opening, e.g., 100% open to reduce flow resistance. If, however, an even faster response is needed (or a command signal to promptly decrease the flow is received), the control unit 266/drive unit 2022 can also be configured to considerably close the upstream valve. Considerably closing the upstream valve can serve to act as a "hydraulic brake" to quickly slow down the flow in the hydraulic system 1 by increasing the back pressure on the hydraulic actuator 3. Of course, the control unit 266/drive unit 2022 can be configured with safeguards so as not to close the upstream valve so far as to starve the hydraulic pump 10. Additionally, as discussed above, the control valves 2014, 2114 can also be controlled to eliminate or reduce instabilities in the hydraulic system 1.

In balanced mode operation, the control unit 266/drive unit 2022 can be configured to take into account both the flow and pressure of the system. For example, the control unit 266/drive unit 2022 can primarily control to a flow set-point during normal operation, but the control unit 266/drive unit 2022 will also ensure that the pressure stays within certain upper and/or lower limits. Conversely, the control unit 266/drive unit 2022 can primarily control to a pressure set-point, but the control unit 266/drive unit 2022 will also ensure that the flow stays within certain upper and/or lower limits. In some embodiments, the hydraulic pump 10 and control valves 2014, 2114 can have dedicated functions. For example, the pressure in the system can be controlled by the hydraulic pump 10 and the flow in the system can be controlled by the control valves 2014, 2114, or vice versa as desired.

In the above exemplary embodiments, in order to ensure that there is sufficient reserve capacity to provide a fast flow response when desired, the control valves 2014, 2114 can be operated in a range that allows for travel in either direction in order to allow for a rapid increase or decrease in the flow or the pressure at the hydraulic actuator 3. For example, the downstream control valve with respect to the hydraulic pump 10 can be operated at a percent opening that is less than 100%, i.e., at a throttled position. That is, the downstream control valve can be set to operate at, e.g., 85% of full valve opening. This throttled position allows for 15% valve travel in the open direction to rapidly increase flow to or pressure at the appropriate port of the hydraulic actuator 3 when needed. Of course, the control valve setting is not limited to 85% and the control valves 2014, 2114 can be operated at any desired percentage. In some embodiments, the control can be set to operate at a percent opening that corresponds to a percent of maximum flow or pressure, e.g., 85% of maximum flow/pressure or some other desired value. While the travel in the closed direction can go down to 0% valve opening to decrease the flow and pressure at the hydraulic actuator 3, to maintain system stability, the valve travel in the closed direction can be limited to, e.g., a percent of valve opening and/or a percent of maximum flow/pressure. For example, the control unit 266/drive unit 2022 can be configured to prevent further closing of the control valves 2014, 2114 if the lower limit with respect to valve opening or percent of maximum flow/pressure is reached. In some embodiments, the control unit 266/drive unit 2022 can limit the control valves 2014, 2114 from opening further if an upper limit of the control valve opening and/or a percent of maximum flow/pressure has been reached.

In some embodiments, the hydraulic system 1 can be a closed-loop hydraulic system. For example, the hydraulic actuator 3, the hydraulic pump 10, the proportional control valve assemblies 2010, 2110, the accumulator 170, the power supply 2020, and the control unit 266/drive unit 2022 shown in FIG. 1 can form a closed-loop hydraulic system. In a closed-loop hydraulic system, the fluid discharged from, e.g., the retraction or extraction chamber of the hydraulic actuator 3, is directed back to the pump 10 and immediately recirculated. As discussed above, the control scheme discussed in the above exemplary embodiment are particularly advantageous in a closed-loop type system since the faster and more precise control of the fluid flow and/or the pressure in the system can mean smaller accumulator sizes and a reduced risk of pump cavitation than in conventional systems. However, the hydraulic system 1 of the present invention is not limited to closed-loop hydraulic systems. For example, the hydraulic system 1 can form an open-loop hydraulic system. In an open-loop hydraulic system, the fluid discharged from, e.g., the hydraulic actuator 3, can be directed to a sump and subsequently drawn from the sump by the pump 10. Thus, the hydraulic system 1 of the present invention can be configured to be a closed-loop system, an open-loop system, or a combination of both without departing the scope of the present disclosure.

In the system shown in FIG. 1, the control valve assemblies 2010, 2110 are shown external to the hydraulic pump 10 with one control valve assembly located on each side of the hydraulic pump 10 along the flow direction. Specifically, the control valve assembly 2010 is disposed between the port B of the hydraulic pump 10 and the port B of the hydraulic actuator 3, and the control valve assembly 2110 is disposed between the port A of the hydraulic pump 10 and the port A of the hydraulic actuator 3. However, in other embodiments, the control valve assemblies 2010, 2110 can be disposed internal to the hydraulic pump 10 (or pump casing). For example, the control valve assembly 2010 can be disposed inside the pump casing on the port B side of the hydraulic pump 10 and the control valve assembly 2110 can be disposed inside the pump casing on the port A side of the hydraulic pump 10.

While the hydraulic system 1 shown in FIG. 1 is illustrated to have a single pump 10 therein, the hydraulic system 1 can have a plurality of hydraulic pumps in other embodiments. For example, the hydraulic system 1 can have two hydraulic pumps therein. Further, the plurality of pumps can be connected in series or in parallel (or combination of both) to the hydraulic system 1 depending on, for example, operational needs of the hydraulic system 1. For instance, if the hydraulic system 1 requires a higher system pressure, a series-connection configuration can be employed for the plurality of pumps. If the hydraulic system 1 requires a higher system flow, a parallel-connection configuration can be employed for the plurality of pumps. The control unit 266/drive unit 2022 can monitor the pressure and/or flow from each of the pumps and control each pump to the desired pressure/flow for that pump, as discussed above.

Figure 2:
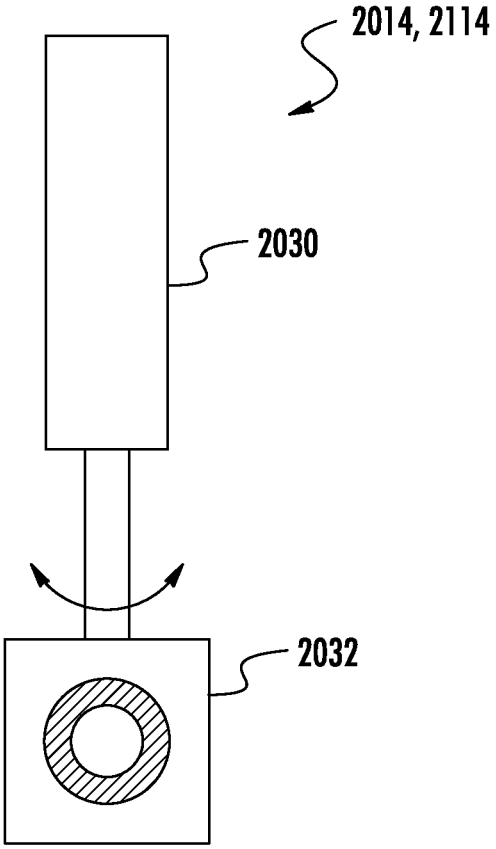
FIG. 2 illustrates an exemplary embodiment of a control valve that can be used in the system of FIG. 1.

As discussed above, the control valve assemblies 2010, 2110 include the control valves 2014, 2114 that can be throttled between 0% to 100% of valve opening. FIG. 2 shows an exemplary embodiment of the control valves 2014, 2114. As illustrated in FIG. 2, each of the control valves 2014, 2114 can include a ball valve 2032 and a valve actuator 2030. The valve actuator 2030 can be an all-electric actuator, i.e., no hydraulics, that opens and closes the ball valve 2032 based on signals from the control unit 266/drive unit 2022 via communication connection 2025, 2125. Embodiments of the present invention, however, are not limited to all-electric actuators and other type of actuators such as electro-hydraulic actuators can be used. The control unit 266/drive unit 2022 can include characteristic curves for the ball valve 2032 that correlate the percent rotation of the ball valve 2032 to the actual or percent cross-sectional opening of the ball valve 2032. The characteristic curves can be predetermined and specific to each type and size of the ball valve 2032 and stored in the control unit 266 and/or drive unit 2022. The characteristic curves, whether for the control valves or the prime movers, can be stored in memory, e.g. RAM, ROM, EPROM, etc. in the form of look-up tables, formulas, algorithms, etc. The control unit 266/drive unit 2022 uses the characteristic curves to precisely control the prime mover 11 and the control valves 2014, 2114. Alternatively, or in addition to the characteristic curves stored in control unit 266/drive unit 2022, the control valves 2014, 2114 and/or the prime movers can also include memory, e.g. RAM, ROM, EPROM, etc. to store the characteristic curves in the form of, e.g., look-up tables, formulas, algorithms, datasets, or another software or hardware component that stores an appropriate relationship, e.g., in the case of the control valves an exemplary relationship can be a correlation between the percent rotation of the ball valve to the actual or percent cross-sectional opening of the ball valve, and in the case of the prime mover, an exemplary relationship can be a correlation between the power input to the prime mover and an actual output speed, flow, pressure, torque or some other prime mover output parameter.

The control unit 266 can be provided to solely control the hydraulic system 1. Alternatively, the control unit 266 can be part of and/or in cooperation with another control system for a machine or an industrial application in which the hydraulic system 1 operates. The control unit 266 can include a central processing unit (CPU) which performs various processes such as commanded operations or pre-programmed routines. The process data and/or routines can be stored in a memory. The routines can also be stored on a storage medium disk such as a hard drive (HDD) or portable storage medium or can be stored remotely. However, the storage media is not limited by the media listed above. For example, the routines can be stored on CDs, DVDs, in FLASH memory, RAM, ROM, PROM, EPROM, EEPROM, hard disk or any other information processing device with which the computer aided design station communicates, such as a server or computer.

The CPU can be a Xenon or Core processor from Intel of America or an Opteron processor from AMD of America, or can be other processor types that would be recognized by one of ordinary skill in the art. Alternatively, the CPU can be implemented on an FPGA, ASIC, PLD or using discrete logic circuits, as one of ordinary skill in the art would recognize. Further, the CPU can be implemented as multiple processors cooperatively working in parallel to perform commanded operations or pre-programmed routines.

The control unit 266 can include a network controller, such as an Intel Ethernet PRO network interface card from Intel Corporation of America, for interfacing with a network. As can be appreciated, the network can be a public network, such as the Internet, or a private network such as a LAN or WAN network, or any combination thereof and can also include PSTN or ISDN sub-networks. The network can also be wired, such as an Ethernet network, or can be wireless, such as a cellular network including EDGE, 3G, and 4G wireless cellular systems. The wireless network can also be WiFi, Bluetooth, or any other wireless form of communication that is known. The control unit 266 can receive a command from an operator via a user input device such as a keyboard and/or mouse via either a wired or wireless communication.

Figure 3:
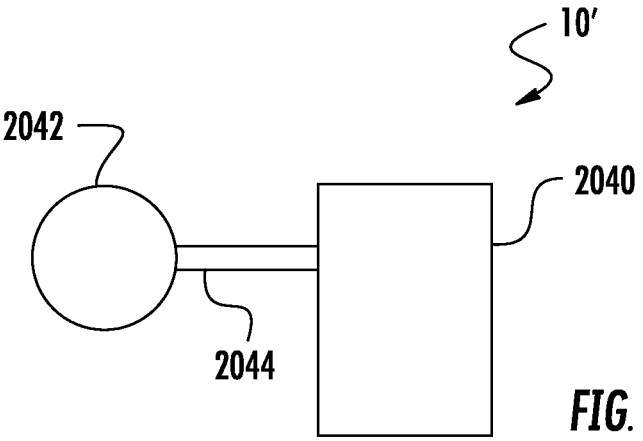
FIG. 3 illustrates an exemplary embodiment of a gear pump that can be used in the system of FIG. 1.

FIG. 3 illustrates an exemplary embodiment of a hydraulic pump that can be used in the above-described fluid system 1. The pump 10' represents a positive-displacement (or fixed displacement) gear pump that can be used as the hydraulic pump 10 in FIG. 1. The gear pump 10' can include a gear assembly 2040 and a motor 2042. The gear assembly 2040 can comprise a casing (or housing) having a cavity in which a pair of gears are arranged. The pair of gears in the gear assembly 2040 can have a driver-driven gear configuration (not shown) typically used in a conventional gear pump. That is, one of the gears is known as a "drive gear" and is driven by a driveshaft attached to an external driver such as an engine or an electric motor. The other gear is known as a "driven gear" (or idler gear), which meshes with the drive gear. The gear pump can be an "internal gear pump," i.e., one of gears is internally toothed and the other gear is externally toothed, or an "external gear pump," i.e., both gears are externally toothed. The external gear pump can use spur, helical, or herringbone gears, depending on the intended application. The motor 2042 can drive the gear assembly 2040 via a shaft 2044. The motor 2042 can be a variable speed, variable torque motor that can be controlled by the control unit 266/drive unit 2022 as described above. Because internal and external gear pumps with a driver-driven configuration are known by those skilled in the art, for brevity, they will not be further discussed.

Figure 4:
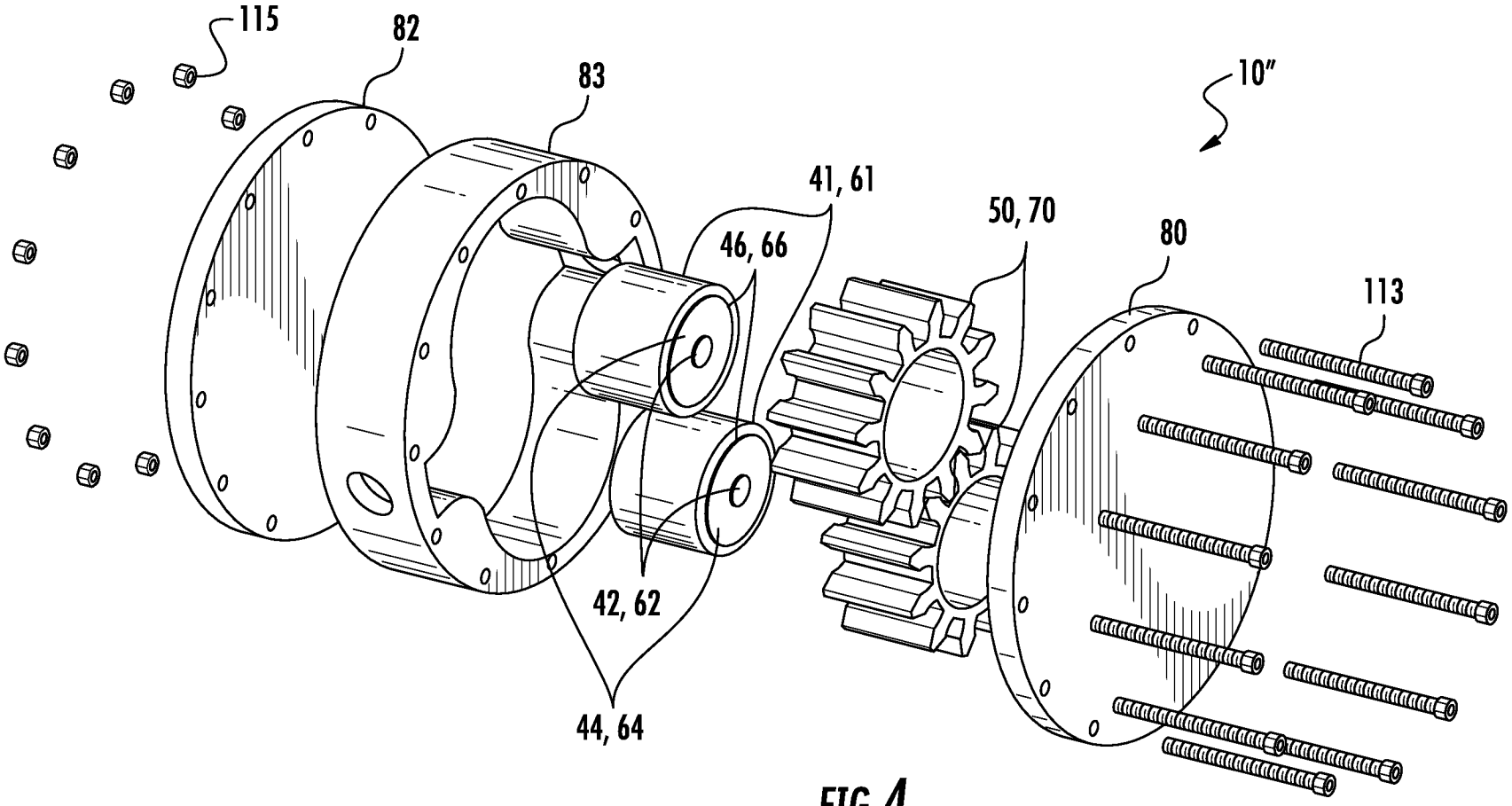
FIG. 4 shows an exploded view of an embodiment of a gear pump that can be used in the system of FIG. 1.

In some embodiments, the pump can include two fluid drivers with each fluid driver including a prime mover and a fluid displacement assembly. The prime movers independently drive the respective fluid displacement assembly. That is, as explained further below with respect to pump 10" in FIGS. 4-6A, these pumps have a drive-drive configuration rather than a driver-driven configuration. FIG. 4 shows an exploded view of an exemplary embodiment of a pump 10"

that can be used in the fluid system 1 described above. Again, for brevity, the exemplary embodiment will be described in terms of an external gear pump having motors as the prime movers. However, as explained above, the present invention is not limited to an external gear pump design, to electric motors as the prime movers, or to gears as the fluid displacement members.

The pump 10" includes two fluid drivers 40, 60 that respectively include motors 41, 61 (prime movers) and gears 50, 70 (fluid displacement members). In this embodiment, both pump motors 41, 61 are disposed inside the pump gears 50, 70. As seen in FIG. 4, the pump 10" represents a positive-displacement (or fixed displacement) gear pump. The pump 10" has a casing 20 that includes end plates 80, 82 and a pump body 83. These two plates 80, 82 and the pump body 83 can be connected by a plurality of through bolts 113 and nuts 115 and the inner surface 26 defines an inner volume 98. To prevent leakage, O-rings or other similar devices can be disposed between the end plates 80, 82 and the pump body 83. The casing 20 has a port 22 and a port 24 (see also FIG. 5), which are in fluid communication with the inner volume 98. During operation and based on the direction of flow, one of the ports 22, 24 is the pump inlet port and the other is the pump outlet port. In an exemplary embodiment, the ports 22, 24 of the casing 20 are round through-holes on opposing side walls of the casing 20. However, the shape is not limiting and the through-holes can have other shapes. In addition, one or both of the ports 22, 24 can be located on either the top or bottom of the casing. Of course, the ports 22, 24 must be located such that one port is on the inlet side of the pump and one port is on the outlet side of the pump.

As seen in FIG. 4, a pair of gears 50, 70 are disposed in the inner volume 98. Each of the gears 50, 70 has a plurality of gear teeth 52, 72 extending radially outward from the respective gear bodies. The gear teeth 52, 72, when rotated by, e.g., electric motors 41, 61, transfer fluid from the inlet to the outlet. In some embodiments, the pump 10" is bi-directional. Thus, either port 22, 24 can be the inlet port, depending on the direction of rotation of gears 50, 70, and the other port will be the outlet port. The gears 50, 70 have cylindrical openings 51, 71 along an axial centerline of the respective gear bodies. The cylindrical openings 51, 71 can extend either partially through or the entire length of the gear bodies. The cylindrical openings are sized to accept the pair of motors 41, 61. Each motor 41, 61 respectively includes a shaft 42, 62, a stator 44, 64, a rotor 46, 66.

Figure 5:
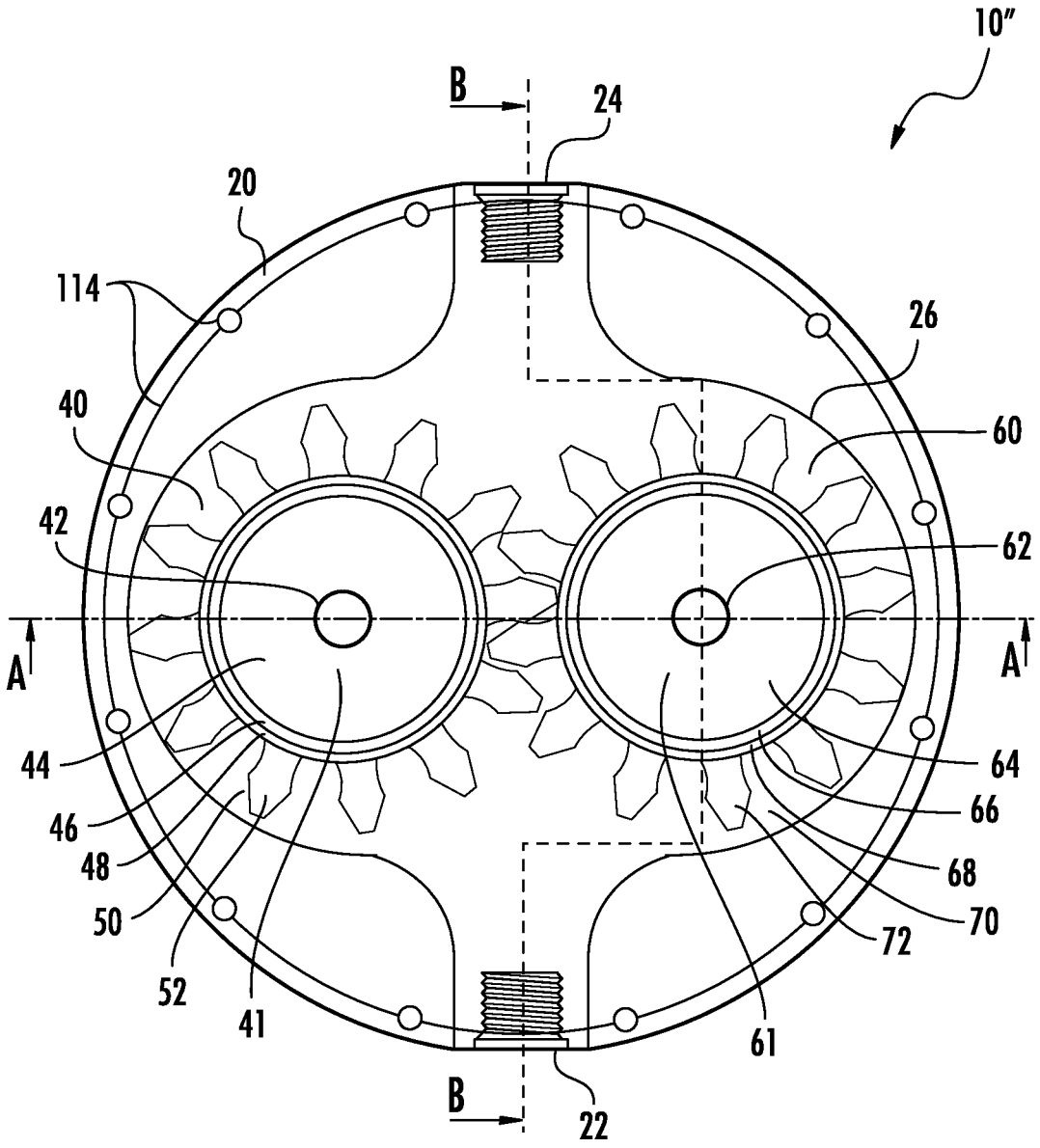
FIG. 5 shows a top cross-sectional view of the external gear pump of FIG. 4.
Figure 5A:
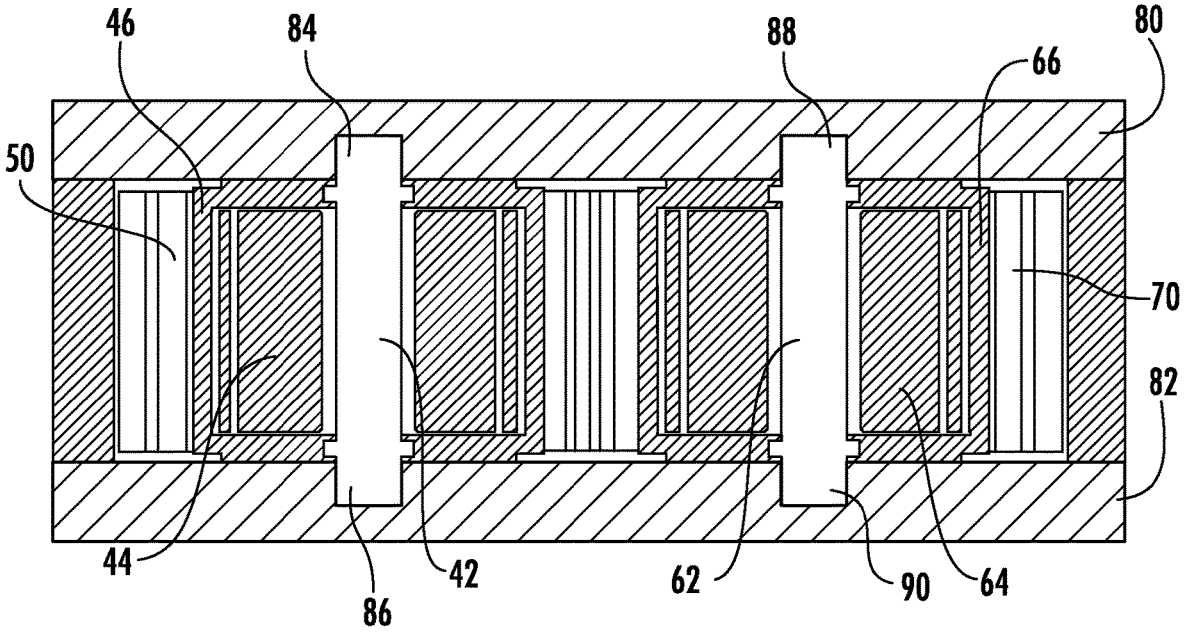
FIG. 5A shows a side cross-sectional view taken along a line A-A in FIG. 5 of the external gear pump.
Figure 5B:
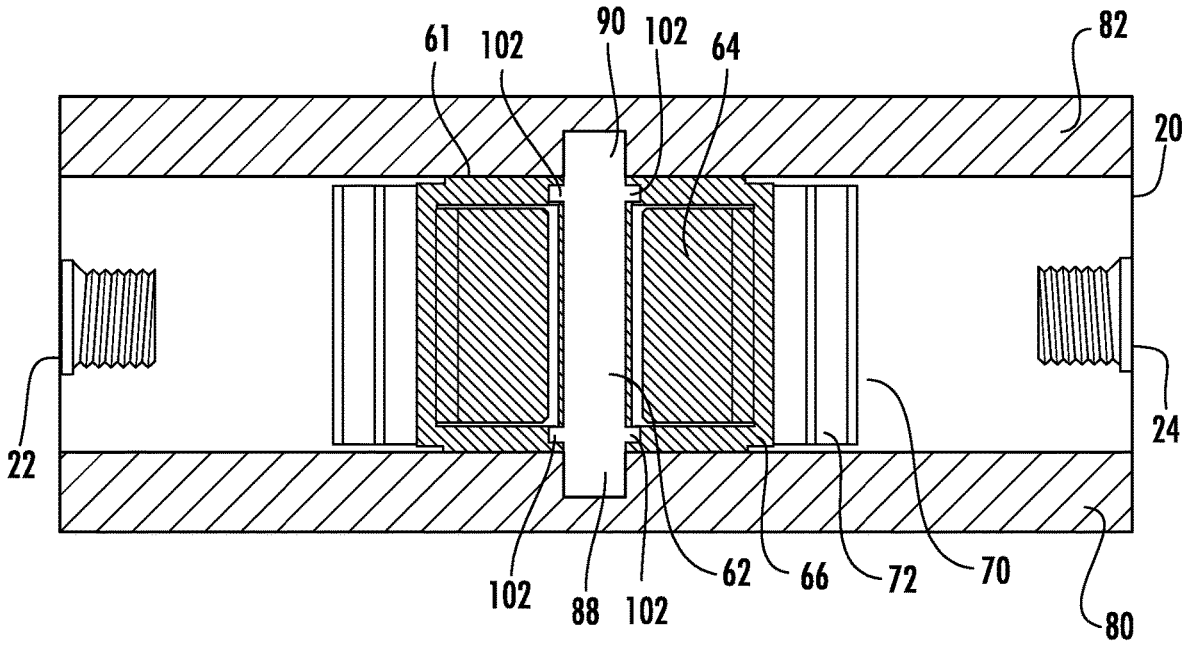
FIG. 5B shows a side cross-sectional view taken along a line B-B in FIG. 2 of a the external gear pump.

FIG. 5 shows a top cross-sectional view of the external gear pump 10" of FIG. 4. FIG. 5A shows a side cross-sectional view taken along a line A-A in FIG. 5 of the external gear pump 10, and FIG. 5B shows a side cross-sectional view taken along a line B-B in FIG. 5A of the external gear pump 10. As seen in FIGS. 5-5B, fluid drivers 40, 60 are disposed in the casing 20. The support shafts 42, 62 of the fluid drivers 40, 60 are disposed between the port 22 and the port 24 of the casing 20 and are supported by the upper plate 80 at one end 84 and the lower plate 82 at the other end 86. However, the means to support the shafts 42, 62 and thus the fluid drivers 40, 60 are not limited to this design and other designs to support the shaft can be used. For example, the shafts 42, 62 can be supported by blocks that are attached to the casing 20 rather than directly by casing 20. The support shaft 42 of the fluid driver 40 is disposed in parallel with the support shaft 62 of the fluid driver 60 and the two shafts are separated by an appropriate distance so that the gear teeth 52, 72 of the respective gears 50, 70 contact each other when rotated.

The stators 44, 64 of motors 41, 61 are disposed radially between the respective support shafts 42, 62 and the rotors 46, 66. The stators 44, 64 are fixedly connected to the respective support shafts 42, 62, which are fixedly connected to the casing 20. The rotors 46, 66 are disposed radially outward of the stators 44, 64 and surround the respective stators 44, 64. Thus, the motors 41, 61 in this embodiment are of an outer-rotor motor design (or an external-rotor motor design), which means that that the outside of the motor rotates and the center of the motor is stationary. In contrast, in an internal-rotor motor design, the rotor is attached to a central shaft that rotates. In an exemplary embodiment, the electric motors 41, 61 are multi directional motors. That is, either motor can operate to create rotary motion either clockwise or counter-clockwise depending on operational needs. Further, in an exemplary embodiment, the motors 41, 61 are variable speed, variable torque motors in which the speed of the rotor and thus the attached gear can be varied to create various volume flows and pump pressures.

As discussed above, the gear bodies can include cylindrical openings 51, 71 which receive motors 41, 61. In an exemplary embodiment, the fluid drivers 40, 60 can respectively include outer support members 48, 68 (see FIG. 5) which aid in coupling the motors 41, 61 to the gears 50, 70 and in supporting the gears 50, 70 on motors 41, 61. Each of the support members 48, 68 can be, for example, a sleeve that is initially attached to either an outer casing of the motors 41, 61 or an inner surface of the cylindrical openings 51, 71. The sleeves can be attached by using an interference fit, a press fit, an adhesive, screws, bolts, a welding or soldering method, or other means that can attach the support members to the cylindrical openings. Similarly, the final coupling between the motors 41, 61 and the gears 50, 70 using the support members 48, 68 can be by using an interference fit, a press fit, screws, bolts, adhesive, a welding or soldering method, or other means to attach the motors to the support members. The sleeves can be of different thicknesses to, e.g., facilitate the attachment of motors 41, 61 with different physical sizes to the gears 50, 70 or vice versa. In addition, if the motor casings and the gears are made of materials that are not compatible, e.g., chemically or otherwise, the sleeves can be made of materials that are compatible with both the gear composition and motor casing composition. In some embodiments, the support members 48, 68 can be designed as a sacrificial piece. That is, support members 48, 68 are designed to be the first to fail, e.g., due to excessive stresses, temperatures, or other causes of failure, in comparison to the gears 50, 70 and motors 41, 61. This allows for a more economic repair of the pump 10 in the event of failure. In some embodiments, the outer support members 48, 68 is not a separate piece but an integral part of the casing for the motors 41, 61 or part of the inner surface of the cylindrical openings 51, 71 of the gears 50, 70. In other embodiments, the motors 41, 61 can support the gears 50, 70 (and the plurality of first gear teeth 52, 72) on their outer surfaces without the need for the outer support members 48, 68. For example, the motor casings can be directly coupled to the inner surface of the cylindrical opening 51, 71 of the gears 50, 70 by using an interference fit, a press fit, screws, bolts, an adhesive, a welding or soldering method, or other means to attach the motor casing to the cylindrical opening. In some embodiments, the outer casings of the motors 41, 61 can be, e.g., machined, cast, or other means to shape the outer casing to form a shape of the gear teeth 52, 72. In still other embodiments, the plurality of gear teeth 52, 72 can be integrated with the respective rotors 46, 66 such that each gear/rotor combination forms one rotary body.

In the above discussed exemplary embodiments, both fluid drivers 40, 60, including electric motors 41, 61 and gears 50, 70, are integrated into a single pump casing 20. This novel configuration of the external gear pump 10 of the present disclosure enables a compact design that provides various advantages. First, the space or footprint occupied by the gear pump embodiments discussed above is significantly reduced by integrating necessary components into a single pump casing, when compared to conventional gear pumps. In addition, the total weight of a pump system is also reduced by removing unnecessary parts such as a shaft that connects a motor to a pump, and separate mountings for a motor/gear driver. Further, since the pump 10 of the present disclosure has a compact and modular design, it can be easily installed, even at locations where conventional gear pumps could not be installed, and can be easily replaced. Detailed description of the pump operation is provided next.

Figure 6:
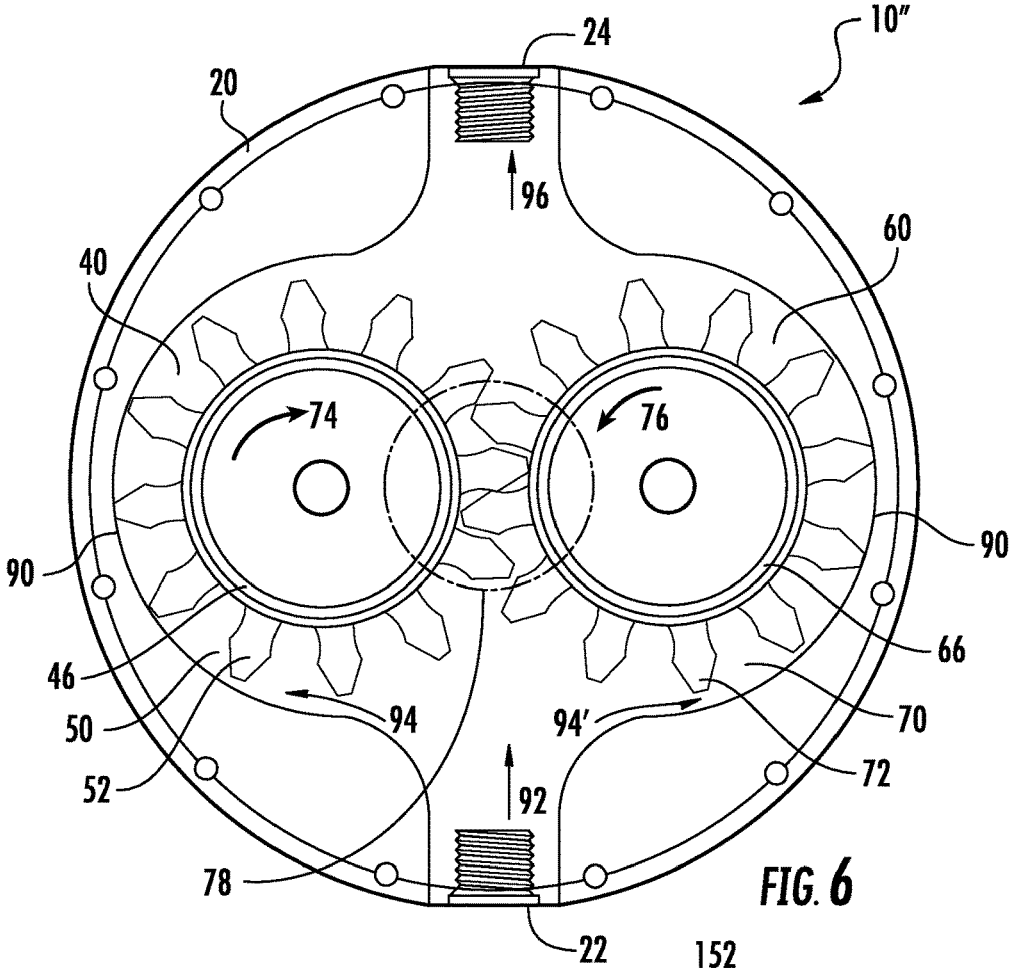
FIG. 6 illustrates exemplary flow paths of the fluid pumped by the external gear pump of FIG. 4.

FIG. 6 illustrates an exemplary fluid flow path of an exemplary embodiment of the external gear pump 10. The ports 22, 24, and a contact area 78 between the plurality of first gear teeth 52 and the plurality of second gear teeth 72 are substantially aligned along a single straight path. However, the alignment of the ports are not limited to this exemplary embodiment and other alignments are permissible. For explanatory purpose, the gear 50 is rotatably driven clockwise 74 by motor 41 and the gear 70 is rotatably driven counter-clockwise 76 by the motor 61. With this rotational configuration, port 22 is the inlet side of the gear pump 10 and port 24 is the outlet side of the gear pump 10. In some exemplary embodiments, both gears 50, 70 are respectively independently driven by the separately provided motors 41, 61.

As seen in FIG. 6, the fluid to be pumped is drawn into the casing 20 at port 22 as shown by an arrow 92 and exits the pump 10 via port 24 as shown by arrow 96. The pumping of the fluid is accomplished by the gear teeth 52, 72. As the gear teeth 52, 72 rotate, the gear teeth rotating out of the contact area 78 form expanding inter-tooth volumes between adjacent teeth on each gear. As these inter-tooth volumes expand, the spaces between adjacent teeth on each gear are filled with fluid from the inlet port, which is port 22 in this exemplary embodiment. The fluid is then forced to move with each gear along the interior wall 90 of the casing 20 as shown by arrows 94 and 94'. That is, the teeth 52 of gear 50 force the fluid to flow along the path 94 and the teeth 72 of gear 70 force the fluid to flow along the path 94'. Very small clearances between the tips of the gear teeth 52, 72 on each gear and the corresponding interior wall 90 of the casing 20 keep the fluid in the inter-tooth volumes trapped, which prevents the fluid from leaking back towards the inlet port. As the gear teeth 52, 72 rotate around and back into the contact area 78, shrinking inter-tooth volumes form between adjacent teeth on each gear because a corresponding tooth of the other gear enters the space between adjacent teeth. The shrinking inter-tooth volumes force the fluid to exit the space between the adjacent teeth and flow out of the pump 10 through port 24 as shown by arrow 96. In some embodiments, the motors 41, 61 are bi-directional and the rotation of motors 41, 61 can be reversed to reverse the direction fluid flow through the pump 10, i.e., the fluid flows from the port 24 to the port 22.

To prevent backflow, i.e., fluid leakage from the outlet side to the inlet side through the contact area 78, contact between a tooth of the first gear 50 and a tooth of the second gear 70 in the contact area 78 provides sealing against the backflow. The contact force is sufficiently large enough to provide substantial sealing but, unlike related art systems, the contact force is not so large as to significantly drive the other gear. In related art driver-driven systems, the force applied by the driver gear turns the driven gear. That is, the driver gear meshes with (or interlocks with) the driven gear to mechanically drive the driven gear. While the force from the driver gear provides sealing at the interface point between the two teeth, this force is much higher than that necessary for sealing because this force must be sufficient enough to mechanically drive the driven gear to transfer the fluid at the desired flow and pressure. This large force causes material to shear off from the teeth in related art pumps. These sheared materials can be dispersed in the fluid, travel through the hydraulic system, and damage crucial operative components, such as O-rings and bearings. As a result, a whole pump system can fail and could interrupt operation of the pump. This failure and interruption of the operation of the pump can lead to significant downtime to repair the pump.

In exemplary embodiments of the pump 10", however, the gears 50, 70 of the pump 10 do not mechanically drive the other gear to any significant degree when the teeth 52, 72 form a seal in the contact area 78. Instead, the gears 50, 70 are rotatably driven independently such that the gear teeth 52, 72 do not grind against each other. That is, the gears 50, 70 are synchronously driven to provide contact but not to grind against each other. Specifically, rotation of the gears 50, 70 are synchronized at suitable rotation rates so that a tooth of the gear 50 contacts a tooth of the second gear 70 in the contact area 78 with sufficient enough force to provide substantial sealing, i.e., fluid leakage from the outlet port side to the inlet port side through the contact area 78 is substantially eliminated. However, unlike the driver-driven configurations discussed above, the contact force between the two gears is insufficient to have one gear mechanically drive the other to any significant degree. Precision control of the motors 41, 61, will ensure that the gear positons remain synchronized with respect to each other during operation.

In some embodiments, rotation of the gears 50, 70 is at least 99% synchronized, where 100% synchronized means that both gears 50, 70 are rotated at the same rpm. However, the synchronization percentage can be varied as long as substantial sealing is provided via the contact between the gear teeth of the two gears 50, 70. In exemplary embodiments, the synchronization rate can be in a range of 95.0% to 100% based on a clearance relationship between the gear teeth 52 and the gear teeth 72. In other exemplary embodiments, the synchronization rate is in a range of 99.0% to 100% based on a clearance relationship between the gear teeth 52 and the gear teeth 72, and in still other exemplary embodiments, the synchronization rate is in a range of 99.5% to 100% based on a clearance relationship between the gear teeth 52 and the gear teeth 72. Again, precision control of the motors 41, 61, will ensure that the gear positons remain synchronized with respect to each other during operation. By appropriately synchronizing the gears 50, 70, the gear teeth 52, 72 can provide substantial sealing, e.g., a backflow or leakage rate with a slip coefficient in a range of 5% or less. For example, for typical hydraulic fluid at about 120 deg. F., the slip coefficient can be can be 5% or less for pump pressures in a range of 3000 psi to 5000 psi, 3% or less for pump pressures in a range of 2000 psi to 3000 psi, 2% or less for pump pressures in a range of 1000 psi to 2000 psi, and 1% or less for pump pressures in a range up to 1000 psi. Of course, depending on the pump type, the synchronized contact can aid in pumping the fluid. For example, in certain internal-gear gerotor designs, the synchronized contact between the two fluid drivers also aids in pumping the fluid, which is trapped between teeth of opposing gears. In some exemplary embodiments, the gears 50, 70 are synchronized by appropriately synchronizing the motors 41, 61. Synchronization of multiple motors is known in the relevant art, thus detailed explanation is omitted here.

Figure 6A:
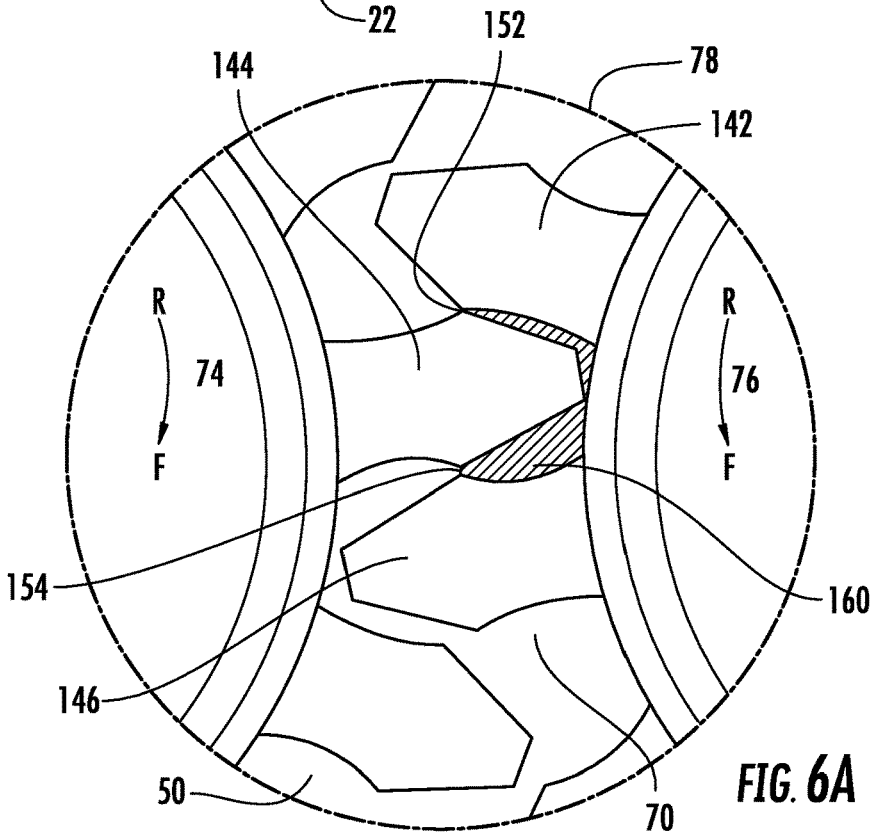
FIG. 6A shows a cross-sectional view illustrating one-sided contact between two gears in a contact area in the external gear pump of FIG. 4.

In an exemplary embodiment, the synchronizing of the gears 50, 70 provides one-sided contact between a tooth of the gear 50 and a tooth of the gear 70. FIG. 6A shows a cross-sectional view illustrating this one-sided contact between the two gears 50, 70 in the contact area 78. For illustrative purposes, gear 50 is rotatably driven clockwise 74 and the gear 70 is rotatably driven counter-clockwise 76 independently of the gear 50. Further, the gear 70 is rotatably driven faster than the gear 50 by a fraction of a second, 0.01 sec/revolution, for example. This rotational speed difference in the demand between the gear 50 and gear 70 enables one-sided contact between the two gears 50, 70, which provides substantial sealing between gear teeth of the two gears 50, 70 to seal between the inlet port and the outlet port, as described above. Thus, as shown in FIG. 6A, a tooth 142 on the gear 70 contacts a tooth 144 on the gear 50 at a point of contact 152. If a face of a gear tooth that is facing forward in the rotational direction 74, 76 is defined as a front side (F), the front side (F) of the tooth 142 contacts the rear side (R) of the tooth 144 at the point of contact 152. However, the gear tooth dimensions are such that the front side (F) of the tooth 144 is not in contact with (i.e., spaced apart from) the rear side (R) of tooth 146, which is a tooth adjacent to the tooth 142 on the gear 70. Thus, the gear teeth 52, 72 are designed such that there is one-sided contact in the contact area 78 as the gears 50, 70 are driven. As the tooth 142 and the tooth 144 move away from the contact area 78 as the gears 50, 70 rotate, the one-sided contact formed between the teeth 142 and 144 phases out. As long as there is a rotational speed difference in the demand between the two gears 50, 70, this one-sided contact is formed intermittently between a tooth on the gear 50 and a tooth on the gear 70. However, because as the gears 50, 70 rotate, the next two following teeth on the respective gears form the next one-sided contact such that there is always contact and the backflow path in the contact area 78 remains substantially sealed. That is, the one-sided contact provides sealing between the ports 22 and 24 such that fluid carried from the pump inlet to the pump outlet is prevented (or substantially prevented) from flowing back to the pump inlet through the contact area 78.

In FIG. 6A, the one-sided contact between the tooth 142 and the tooth 144 is shown as being at a particular point, i.e. point of contact 152. However, a one-sided contact between gear teeth in the exemplary embodiments is not limited to contact at a particular point. For example, the one-sided contact can occur at a plurality of points or along a contact line between the tooth 142 and the tooth 144. For another example, one-sided contact can occur between surface areas of the two gear teeth. Thus, a sealing area can be formed when an area on the surface of the tooth 142 is in contact with an area on the surface of the tooth 144 during the one-sided contact. The gear teeth 52, 72 of each gear 50, 70 can be configured to have a tooth profile (or curvature) to achieve one-sided contact between the two gear teeth. In this way, one-sided contact in the present disclosure can occur at a point or points, along a line, or over surface areas. Accordingly, the point of contact 152 discussed above can be provided as part of a location (or locations) of contact, and not limited to a single point of contact.

In some exemplary embodiments, the teeth of the respective gears 50, 70 are designed so as to not trap excessive fluid pressure between the teeth in the contact area 78. As illustrated in FIG. 6A, fluid 160 can be trapped between the teeth 142, 144, 146. While the trapped fluid 160 provides a sealing effect between the pump inlet and the pump outlet, excessive pressure can accumulate as the gears 50, 70 rotate. In a preferred embodiment, the gear teeth profile is such that a small clearance (or gap) 154 is provided between the gear teeth 144, 146 to release pressurized fluid. Such a design retains the sealing effect while ensuring that excessive pressure is not built up. Of course, the point, line or area of contact is not limited to the side of one tooth face contacting the side of another tooth face. Depending on the type of fluid displacement member, the synchronized contact can be between any surface of at least one projection (e.g., bump, extension, bulge, protrusion, other similar structure or combinations thereof) on the first fluid displacement member and any surface of at least one projection (e.g., bump, extension, bulge, protrusion, other similar structure or combinations thereof) or an indent (e.g., cavity, depression, void or similar structure) on the second fluid displacement member. In some embodiments, at least one of the fluid displacement members can be made of or include a resilient material, e.g., rubber, an elastomeric material, or another resilient material, so that the contact force provides a more positive sealing area. Further details of hydraulic pump 10" and other drive-drive pump configurations can be found in International Application No. PCT/US2015/018342 filed Mar. 2, 2015 and U.S. patent application Ser. No. 14/637,064 filed Mar. 3, 2015 by the present Inventor and which are incorporated herein by reference in their entirety.

Referring back to FIG. 1, in some embodiments, the pump 10 can be replaced with the pump 10' (see FIG. 3) or pump 10" (see FIG. 4) in the hydraulic system 1. Further, in other embodiments, instead of a single pump 10, 10', 10", a plurality of pumps 10, 10', 10" (or any combination) can be utilized depending on operational needs of the hydraulic system 1. As discussed above, the plurality of pumps can have, for example, a series-connection or a parallel-connection.

In other embodiments, one or more pumps 10" can have a control valve assembly 2010, 2110 disposed internal to the pump 10" (or the casing 20 of the pump 10"). For example, referring to FIGS. 1 and 5, the control valve assembly 2010 can be disposed internal to the casing 20 and in the vicinity of the port 22, and the control valve assembly 2110 can be disposed internal to the casing 20 and in the vicinity of the port 24. In this configuration, as the control valve assemblies 2010, 2110 are disposed proximate to the pump 10", control responsiveness of the control valve assemblies 2010, 2110 can be improved. Further, the valve assemblies 2010, 2110 are included inside the casing 20 of the pump 10", compact design of the hydraulic system 1 can be achieved. The control unit 266/drive unit 2022 can monitor the pressure and/or flow from each of the pumps or pump/valve assembly, and control each pump or pump/valve assembly to the desired pressure/flow for that pump or pump/valve assembly, as discussed above.

In addition, although embodiments in which the prime mover was disposed inside the fluid displacement member was described in a two-fluid driver configuration, those skilled in the art will understand that the prime mover can be disposed inside the fluid displacement member in a single fluid driver configuration. For example, in the system of FIG. 1, the prime mover 11 can be an integral part of the fluid displacement assembly 12, i.e., the prime mover 11 can be, e.g., an electric motor that is disposed within a fluid displacement member of the fluid displacement assembly 12. For example, in the gear pump of FIG. 3, the motor 2042 can be an integral part of the gear assembly 2040.

Although the above drive-drive and driver-driven embodiments were described with respect to an external gear pump arrangement with spur gears having gear teeth and electric motors as prime movers, it should be understood that those skilled in the art will readily recognize that the concepts, functions, and features described below can be readily adapted to external gear pumps with other gear configurations (helical gears, herringbone gears, or other gear teeth configurations that can be adapted to drive fluid), internal gear pumps with various gear configurations, to pumps having more than two prime movers, to prime movers other than electric motors, e.g., hydraulic motors or other fluid-driven motors, inter-combustion, gas or other type of engines or other similar devices that can drive a fluid displacement member, and to fluid displacement members other than an external gear with gear teeth, e.g., internal gear with gear teeth, a hub (e.g. a disk, cylinder, other similar component) with projections (e.g. bumps, extensions, bulges, protrusions, other similar structures or combinations thereof), a hub (e.g. a disk, cylinder, or other similar component) with indents (e.g., cavities, depressions, voids or other similar structures), a gear body with lobes, or other similar structures that can displace fluid when driven. Accordingly, for brevity, detailed description of the various pump configurations are omitted. In addition, those skilled in the art will recognize that, depending on the type of pump, the synchronizing contact (drive-drive) or meshing (driver-driven) can aid in the pumping of the fluid instead of or in addition to sealing a reverse flow path. For example, in certain internal-gear georotor configurations, the synchronized contact or meshing between the two fluid displacement members also aids in pumping the fluid, which is trapped between teeth of opposing gears. Further, while the above embodiments have fluid displacement members with an external gear configuration, those skilled in the art will recognize that, depending on the type of fluid displacement member, the synchronized contact or meshing is not limited to a side-face to side-face contact and can be between any surface of at least one projection (e.g. bump, extension, bulge, protrusion, other similar structure, or combinations thereof) on one fluid displacement member and any surface of at least one projection (e.g. bump, extension, bulge, protrusion, other similar structure, or combinations thereof) or indent (e.g., cavity, depression, void or other similar structure) on another fluid displacement member.

The fluid displacement members, e.g., gears in the above embodiments, can be made entirely of any one of a metallic material or a non-metallic material. Metallic material can include, but is not limited to, steel, stainless steel, anodized aluminum, aluminum, titanium, magnesium, brass, and their respective alloys. Non-metallic material can include, but is not limited to, ceramic, plastic, composite, carbon fiber, and nano-composite material. Metallic material can be used for a pump that requires robustness to endure high pressure, for example. However, for a pump to be used in a low pressure application, non-metallic material can be used. In some embodiments, the fluid displacement members can be made of a resilient material, e.g., rubber, elastomeric material, to, for example, further enhance the sealing area.

Alternatively, the fluid displacement member, e.g., gears in the above embodiments, can be made of a combination of different materials. For example, the body can be made of aluminum and the portion that makes contact with another fluid displacement member, e.g., gear teeth in the above exemplary embodiments, can be made of steel for a pump that requires robustness to endure high pressure, a plastic for a pump for a low pressure application, a elastomeric material, or another appropriate material based on the type of application.

Exemplary embodiments of the fluid delivery system can displace a variety of fluids. For example, the pumps can be configured to pump hydraulic fluid, engine oil, crude oil, blood, liquid medicine (syrup), paints, inks, resins, adhesives, molten thermoplastics, bitumen, pitch, molasses, molten chocolate, water, acetone, benzene, methanol, or another fluid. As seen by the type of fluid that can be pumped, exemplary embodiments of the pump can be used in a variety of applications such as heavy and industrial machines, chemical industry, food industry, medical industry, commercial applications, residential applications, or another industry that uses pumps. Factors such as viscosity of the fluid, desired pressures and flow for the application, the configuration of the fluid displacement member, the size and power of the motors, physical space considerations, weight of the pump, or other factors that affect pump configuration will play a role in the pump arrangement. It is contemplated that, depending on the type of application, the exemplary embodiments of the fluid delivery system discussed above can have operating ranges that fall with a general range of, e.g., 1 to 5000 rpm. Of course, this range is not limiting and other ranges are possible.

The pump operating speed can be determined by taking into account factors such as viscosity of the fluid, the prime mover capacity (e.g., capacity of electric motor, hydraulic motor or other fluid-driven motor, internal-combustion, gas or other type of engine or other similar device that can drive a fluid displacement member), fluid displacement member dimensions (e.g., dimensions of the gear, hub with projections, hub with indents, or other similar structures that can displace fluid when driven), desired flow rate, desired operating pressure, and pump bearing load. In exemplary embodiments, for example, applications directed to typical industrial hydraulic system applications, the operating speed of the pump can be, e.g., in a range of 300 rpm to 900 rpm. In addition, the operating range can also be selected depending on the intended purpose of the pump. For example, in the above hydraulic pump example, a pump configured to operate within a range of 1-300 rpm can be selected as a stand-by pump that provides supplemental flow as needed in the hydraulic system. A pump configured to operate in a range of 300-600 rpm can be selected for continuous operation in the hydraulic system, while a pump configured to operate in a range of 600-900 rpm can be selected for peak flow operation. Of course, a single, general pump can be configured to provide all three types of operation.

The applications of the exemplary embodiments can include, but are not limited to, reach stackers, wheel loaders, forklifts, mining, aerial work platforms, waste handling, agriculture, truck crane, construction, forestry, and machine shop industry. For applications that are categorized as light size industries, exemplary embodiments of the pump discussed above can displace from 2 $cm^3$/rev (cubic centimeters per revolution) to 150 $cm^3$/rev with pressures in a range of 1500 psi to 3000 psi, for example. The fluid gap, i.e., tolerance between the gear teeth and the gear housing which defines the efficiency and slip coefficient, in these pumps can be in a range of +0.00-0.05 mm, for example. For applications that are categorized as medium size industries, exemplary embodiments of the pump discussed above can displace from 150 $cm^3$/rev to 300 $cm^3$/rev with pressures in a range of 3000 psi to 5000 psi and a fluid gap in a range of +0.00-0.07 mm, for example. For applications that are categorized as heavy size industries, exemplary embodiments of the pump discussed above can displace from 300 $cm^3$/rev to 600 $cm^3$/rev with pressures in a range of 3000 psi to 12,000 psi and a fluid gap in a range of +0.00-0.0125 mm, for example.

In addition, the dimensions of the fluid displacement members can vary depending on the application of the pump. For example, when gears are used as the fluid displacement members, the circular pitch of the gears can range from less than 1 mm (e.g., a nano-composite material of nylon) to a few meters wide in industrial applications. The thickness of the gears will depend on the desired pressures and flows for the application.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A hydraulic system comprising:

a hydraulic pump to provide hydraulic fluid to a hydraulic actuator having first and second ports, the hydraulic pump including, at least one electric motor, a gear assembly configured to be driven by the at least one electric motor such that the fluid is transferred from an inlet port of the hydraulic pump to an outlet port of the hydraulic pump; and a control valve disposed on a side of the inlet port or the outlet port, wherein the control valve is configured to be throttled; and a controller configured to operate the at least one electric motor to control a flow in the hydraulic system to a flow set point or a pressure in the hydraulic system to a pressure set point, the controller further configured to operate the control valve to control the flow in the hydraulic system to the flow set point or the pressure in the hydraulic system to the pressure set point.

2. The hydraulic system of claim 1, wherein the hydraulic system is a closed-loop system.

3. The hydraulic system of claim 1, wherein the control valve is throttleable between 0% and 100%.

4. The hydraulic system of claim 1, wherein the control valve is a ball valve.

5. The hydraulic system of claim 4, wherein the controller includes a characteristic curve for the ball valve that correlates a rotational position of the ball valve to a cross-sectional opening of the ball valve.

6. The hydraulic system of claim 1, wherein the at least one electric motor includes a first electric motor and a second electric motor, and the gear assembly includes a first gear to transfer the fluid, the first gear having a plurality of first gear teeth, and a second gear to transfer the fluid, the second gear having a plurality of second gear teeth, wherein the first electric motor rotates the first gear about a first axial centerline of the first gear in a first direction to transfer the fluid, and the second electric motor rotates the second gear, independently of the first electric motor, about a second axial centerline of the second gear in a second direction to transfer the fluid, and wherein the first electric motor and the second electric motor are controlled so as to synchronize contact between a face of at least one tooth of the plurality of second gear teeth and a face of at least one tooth of the plurality of first gear teeth.

7. The hydraulic system of claim 6, wherein the first electric motor is disposed inside the first gear and the second electric motor is disposed inside the second gear.

8. The hydraulic system of claim 6, wherein the synchronized contact is such that a slip coefficient is 5% or less.

9. The hydraulic system of claim 1, further comprising an accumulator.

10. The hydraulic system of claim 1, wherein the hydraulic pump is configured to operate in a range of 300 rpm to 900 rpm.

11. A method for controlling a fluid flow in a hydraulic system, the hydraulic system including a hydraulic pump and a throttleable control valve, the hydraulic pump to provide hydraulic fluid to a hydraulic actuator that controls a load, the hydraulic pump including at least one electric motor and a fluid displacement assembly to be driven by the at least one electric motor, the method comprising:

controlling, in response to a change in demand of a fluid flow or a pressure in the hydraulic system, a flow in the hydraulic system to a flow set point or a pressure in the hydraulic system to a pressure set point using the electric motor; and concurrently operating the control valve to control the flow in the hydraulic system to the flow set point or the pressure in the hydraulic system to the pressure set point.

12. The method of claim 11, wherein the operation of the hydraulic pump is initiated in a closed-loop system.

13. The method of claim 12, wherein the control valve is throttleable between 0% and 100%.

14. The method of claim 11, wherein the control valve is a ball valve.

15. The method of claim 14, wherein the controller includes a characteristic curve for the ball valve that correlates a rotational position of the ball valve to a cross-sectional opening of the ball valve.

16. The method of claim 11, further comprising:

controlling a first electric motor of the at least one electric motor and a second electric motor of the at least one electric motor to synchronize contact between a first gear of the fluid displacement assembly and a second gear of the fluid displacement assembly, wherein the first electric motor drives the first gear and the second electric motor drives the second gear.

17. The method of claim 16, wherein the first electric motor is disposed inside the first gear and the second electric motor is disposed inside the second gear.

18. The method of claim 16, wherein the synchronized contact is such that a slip coefficient is 5% or less.

19. The method of claim 11, wherein the hydraulic system includes an accumulator.

20. The method of claim 11, wherein the hydraulic pump is configured to operate in a range of 300 rpm to 900 rpm.

* * * * *